US011398681B2

(12) United States Patent
Abramov

(10) Patent No.: US 11,398,681 B2
(45) Date of Patent: Jul. 26, 2022

(54) SHAPE MEMORY DEPLOYABLE ANTENNA SYSTEM

(71) Applicant: Igor Abramov, Vista, CA (US)

(72) Inventor: Igor Abramov, Vista, CA (US)

( * ) Notice: Subject to any disclaimer, the term of this patent is extended or adjusted under 35 U.S.C. 154(b) by 0 days.

(21) Appl. No.: 16/922,930

(22) Filed: Jul. 7, 2020

(65) Prior Publication Data

US 2022/0013918 A1 Jan. 13, 2022

(51) Int. Cl.
*H01Q 15/16* (2006.01)
*H01Q 1/28* (2006.01)

(52) U.S. Cl.
CPC ..... *H01Q 15/161* (2013.01); *H01Q 1/288* (2013.01)

(58) Field of Classification Search
CPC ..... H01Q 15/16; H01Q 15/161; H01Q 1/12; H01Q 1/1235; H01Q 1/27; H01Q 1/28; H01Q 1/288
See application file for complete search history.

(56) References Cited

U.S. PATENT DOCUMENTS 5,975,468 A * 11/1999 Moignier ..... F03G 7/065 60/527
6,344,835 B1 * 2/2002 Allen ..... H01Q 1/288 343/915
2002/0014992 A1 * 2/2002 Sun ..... H01Q 3/01 343/846
2004/0085615 A1 * 5/2004 Hill ..... H01Q 15/161 359/288
2009/0213031 A1 * 8/2009 Taylor ..... H01Q 15/161 29/600
2010/0188311 A1 * 7/2010 Taylor ..... H01Q 19/132 343/915
2013/0207880 A1 * 8/2013 Taylor ..... H01Q 15/20 343/915
2015/0288060 A1 * 10/2015 Corliss ..... H01Q 9/38 343/848
2016/0352022 A1 * 12/2016 Thomson ..... H01Q 1/288
2017/0201031 A1 * 7/2017 Gelb ..... H01Q 13/0283
2019/0131714 A1 * 5/2019 Shmuel ..... H01Q 15/161
2019/0393615 A1 * 12/2019 Taylor ..... B33Y 10/00
2022/0013918 A1 * 1/2022 Abramov ..... H01Q 1/288
2022/0013919 A1 * 1/2022 Abramov ..... H01Q 15/161

* cited by examiner

*Primary Examiner* — Jason Crawford

(57) ABSTRACT

Described are several embodiments of parabolic reflective antenna systems where a flexible primary reflector is supported by radial ribs of shape memory material deployed by application of heat. Several feeds made with shape memory materials working with the reflector are presented. Feed preforms include corrugated, telescopic and flattened ribbon types which extend or unfurl into final shapes upon application of heat. Several antenna and feed embodiments also contain supports for secondary reflectors and patch antennas.

28 Claims, 23 Drawing Sheets

SHAPE MEMORY DEPLOYABLE ANTENNA SYSTEM

FIELD OF INVENTION

This invention relates to deployable antennae in general and to shape memory deployable antenna in particular.

BACKGROUND OF INVENTION

Parabolic reflector antennae are desirable for many types of space communications as they offer the highest so-called antenna 'gain' (concentration and beam width of the signal energy) and through it, extend a satellite's effective communications range. For a given electromagnetic wavelength, the larger the diameter of an antenna, the higher its 'gain'.

Other types of antennae, for example, a patch-type, have only moderate gain figures, as their underlying technologies preclude their attaining the high gains of parabolic reflector antennae.

Rigid permanent dish antennae due to their size and geometry are largely not feasible for mini-, micro- and nano-satellites. Present deployable dish antennae have been largely unfeasible as well, due to their size, shape, weight and deployment mechanism complexity.

At present, deployable paraboloid reflector antennae used in satellites generally fall into two groups. One group comprises dish antenna assemblies with several petal-shaped rigid elements forming a paraboloid reflector when unfolded. Because these elements are rigid, they are often stowed as a stack, to be opened and deployed rotationally.

The other group includes antenna reflectors which comprise a set of supports to which a flexible reflective membrane is attached. The supporting structures, such as radial ribs, are relatively rigid and are customarily stowed as an elongated bundle folded along its longitudinal axis. When deployed some membrane supporting structures take a form of complex three-dimensional lattices which unfurl/unfold in space and support the attached reflective membrane in the required paraboloid shape.

A wide variety of the paraboloid reflector antenna deployment mechanisms exist or have been proposed. They include mechanical gearing assemblies, cables and tensioners and some limited shape memory actuators. Majority of them are mechanically quite complex and sometimes fail to deploy the antennae.

The present deployable paraboloid reflector assemblies are awkward to store since they have to be located and oriented in very limited and specific ways to conform to the available envelopes aboard the launch vehicles while still be a part of a satellite.

Also, because of the necessity to conform to the launch vehicle's configuration and the overall satellite physical envelope, the location selection of the antenna on a satellite itself is complicated, subject to numerous constraints and trade-offs.

Additionally, the sometimes off-axis placement of the antenna deployment mechanism adversely affects the center of gravity and rotational moments of a satellite and introduces complications for in-flight positioning and maneuvering of a satellite.

The addition of the deployment mechanisms and their rigid mechanical interfaces with the antennae themselves add to the assemblies' bulk, weight and complexity, the latter leading to their reduced overall reliability.

Objectives of the Invention

Thus, it is the objective of instant invention to provide a compact deployable paraboloid reflector antenna assembly which would prior to deployment be stowable in a variety of locations and at various attitudes on the satellite.

Another objective is to provide antennae whose deployment would be reliable.

Another objective is to provide antennae with high volumetric packing efficiency.

Yet another objective is to provide antennae which would not require separate mechanical deployment mechanism.

Another objective is to provide antennae which would be lightweight.

Yet another objective is to provide antennae which would be compatible with deep space environment.

Another objective is to provide antennae whose deployment would be energy efficient.

SUMMARY OF THE INVENTION

In accordance with the present invention, shape memory based deployable antennae are described. Several embodiments are illustrated, some with shape memory radially extending ribs which support a reflective membrane and some where a solid reflective paraboloid is formed from a tightly folded shape memory preform sheet.

The shape memory antenna elements such as supporting ribs or the paraboloid reflector itself during manufacturing are formed into their desired deployed shape.

Subsequently, for packaging they are mechanically restrained in the packaged geometry while being heated at—or above the phase—or glass transition temperature of the shape memory material.

Afterwards, they are allowed to cool off and the mechanical constraints are removed. The packaged antennae elements can be highly folded/corrugated or coiled to provide for efficient storage.

The shape memory antennae elements remain in their packaged configuration until they are heated for deployment to—or above the phase—or glass transition temperature of the shape memory material, and return to their original as-manufactured shape.

In addition to the supporting ribs and the reflector paraboloid reflector itself, several shape memory antenna feeds are also described, some with telescopic waveguide elements extended by several types of shape memory actuators and some having an extendable shape memory waveguides formed from corrugated shape memory preforms. These feeds can be used interchangeably with the shape memory antenna paraboloid reflectors.

Some antennae, in addition include deployable sub-reflectors positioned above the main reflector and facing the feeds, and some use small patch antennas instead of feeds and sub-reflectors.

Prior Art

The prior art for deployable antennae is extensive, since these antennae have been a key piece of communications equipment for satellites from the dawn of space exploration.

For example, U.S. Pat. No. 7,710,348 to Taylor et al. teaches a deployable antenna reflector which utilizes a shape memory element to open conventional rigid ribs supporting a flexible reflector.

U.S. Pat. Nos. 8,259,033 and 9,281,569, both to Taylor et al. teach a deployable antenna reflector with longitudinal and circumferential shape memory stiffeners supporting a reflective elastic material.

U.S. Pat. No. 10,170,843 to Thomson et al. teaches mechanically actuated foldable support conventional ribs for antenna reflector and a pleated foldable reflector itself.

None of the prior art above suggests or teaches shape memory support ribs which extend radially, as per instant invention.

None teaches a deployable shape memory solid reflector created from a folded/corrugated preform.

None teaches deployable shape memory antenna feeds or sub-reflector supports, or using patch antennas in conjunction with parabolic reflectors.

Objects and Advantages

In contrast to the prior art mentioned hereinabove, the instant invention describes shape memory paraboloid reflector antennae which offer the following advantages.

High Volumetric Storage Efficiency

The supporting reflector elements of the instant antennae systems extend radially outwards and as a result are advantageously stored very compactly prior to deployment. Since they do not require direct mechanical actuation, but merely application of heat, the elements can be tightly folded or coiled, thus offering a very dense package. The required heaters can be very compact.

In addition, the very shapes of the deployable elements, thanks to their being made from shape memory materials, can be optimized for storage (such as coiling), to revert to operational shape (also optimized) upon deployment. Thus, greater design latitudes exist to optimize packaging, interface with the satellite, and deployment of the antennae.

Light Weight

Due to the absence of the relatively heavy mechanical deployment drives, the weight of instant antenna systems is greatly reduced. The required heaters can be very thin and lightweight and in some applications the actuating heat can be generated by passing electric current directly through the support elements themselves. A completely passive heating and antenna deployment can be achieved by exposing antenna elements to sunlight by appropriately maneuvering the satellite. In the vacuum of space, solar heating can be considerable.

No Complicated Pleating/Folding of the Flexible Reflector or Support Structures

The precisely timed deployment of the antennae support elements and the way they deploy, e.g. their 3-dimensional deployment movement, can be accurately controlled by localized and timed application of heat to the elements. In contrast, it is difficult to achieve a complex movement with mechanical deployment actuators without incurring considerable design complexity and lowered reliability. In contrast, the deployment of the flexible reflector of instant invention is well controlled and so it can be stowed in a very compact folded package prior to deployment.

Simplified Construction

The deployment heaters of instant invention are much smaller and less complicated than mechanical actuators of the present deployable antennas. There are basically no separate 'actuators' per se, other than heaters, with the support elements deploying themselves upon application of heat, having stored elastic energy at the time of packaging.

Improved Reliability

With thermal actuation of instant invention replacing present electro-mechanical actuators the instant antennae systems are much more reliable, since the only moving parts are the very support elements themselves being deployed. With timed heater activation specific deployment sequences are possible to minimize the risk of malfunction.

Easier Redundancy Implementation

Since it is much easier to provide redundancy to an electrically heated deployment system than to a mechanical actuator(s)-based one, the shape memory based antennae systems can have more redundancy of their deployment apparatuses.

Heating and Deployment by Sunlight

As mentioned above, since heating of satellite components by solar radiation in space can be considerable, the support elements can be exposed to sunlight instead of heaters for deployment. This also can be used as a backup procedure in case of a heater failure. To facilitate sunlight heating the support elements can have radiation-absorptive coating(s).

High Stored Energy

The shape memory materials used for the support elements store considerable elastic energy and can generate considerable forces during deployment to overcome potential adhesions, friction and snags.

Relaxed Requirements for Orientation/Location on Satellite or Launch Vehicle.

Due to the compact size of the antennae assemblies their locations on a satellite are not as restrictive as for the present deployable antennae systems. This can simplify the design of the satellite itself and/or its operations, since the antenna or satellite itself may not have to be re-targeted/re-pointed after deployment to support antenna operations. In addition, an antenna assembly can be more easily placed to minimize its effect on the location of the satellite's center of gravity, which will simplify satellite operations.

DESCRIPTION OF THE EMBODIMENTS

In the foregoing description like components are labeled by the like numerals.

Figure 1:
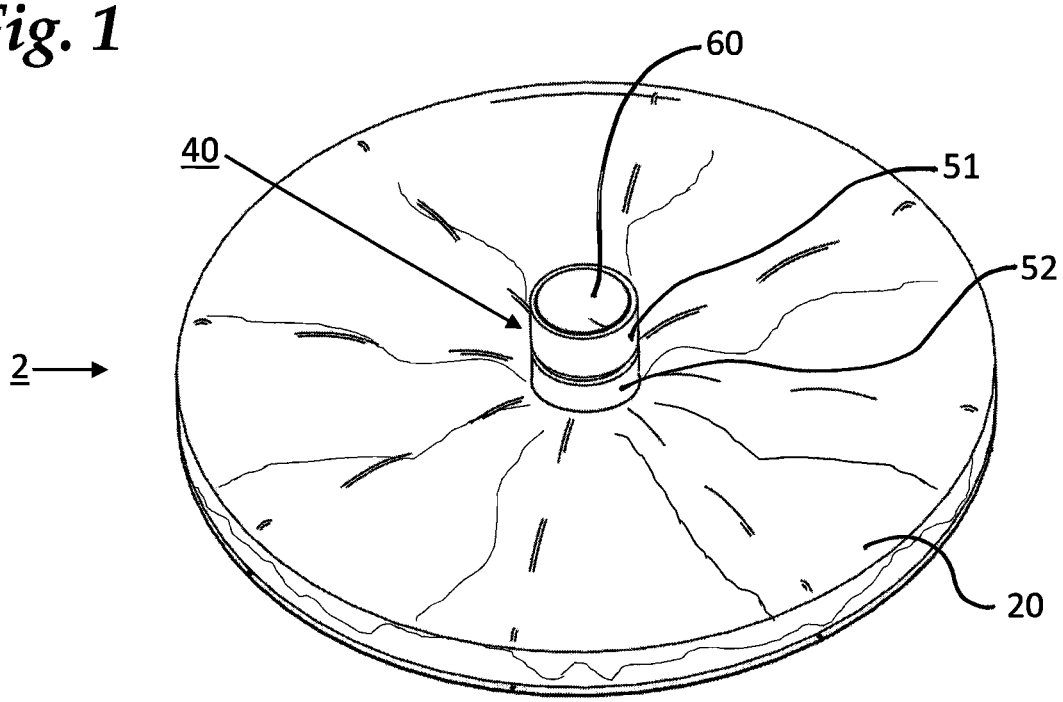
FIG. 1 is a perspective view of the antenna assembly embodiment 2 in stowed configuration.

Deployable antenna assembly 2 is depicted on FIGS. 1 through 6. Referring to FIG. 1, antenna assembly 2 in stowed configuration comprises pliable primary reflector 20 folded into essentially a cylindrical shape. Feed assembly 40 coaxially extends through the middle of the packaged reflector 20 and is surrounded by coaxial upper heater 51 and lower heater 52. Secondary reflector 60 is included on top of feed assembly 40 supported by elements 44 (not visible). Main reflector support rib elements 10 are not visible in this figure and neither are their respective bottom heaters 55*a*, 55*b* and 55*c*.

Figure 1A:
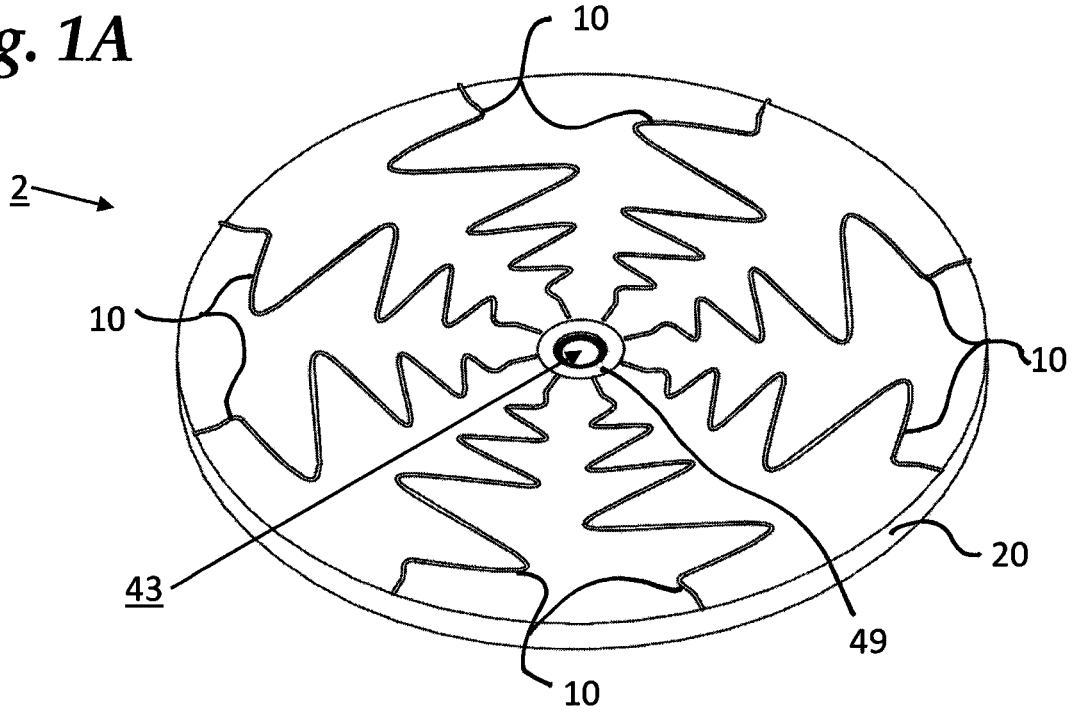
FIG. 1A is a perspective view of the bottom of the antenna assembly embodiment 2 in stowed configuration (heaters not shown).

FIG. 1A shows the bottom of the antenna assembly 2 in stowed configuration wherein supporting rib elements 10 are connected to the central tubular hub integral with lower heater 52. Rib elements 10 in stowed configuration are advantageously folded into meandering trapezoidal shapes to efficiently utilize circular envelope volume under reflector 20 and thus increase packaging density of the assembly. Bottom heaters 55*a*, 55*b* and 55*c* are not shown for clarity. The lumen of feed assembly 40 is denoted by numeral 43.

Figure 2:
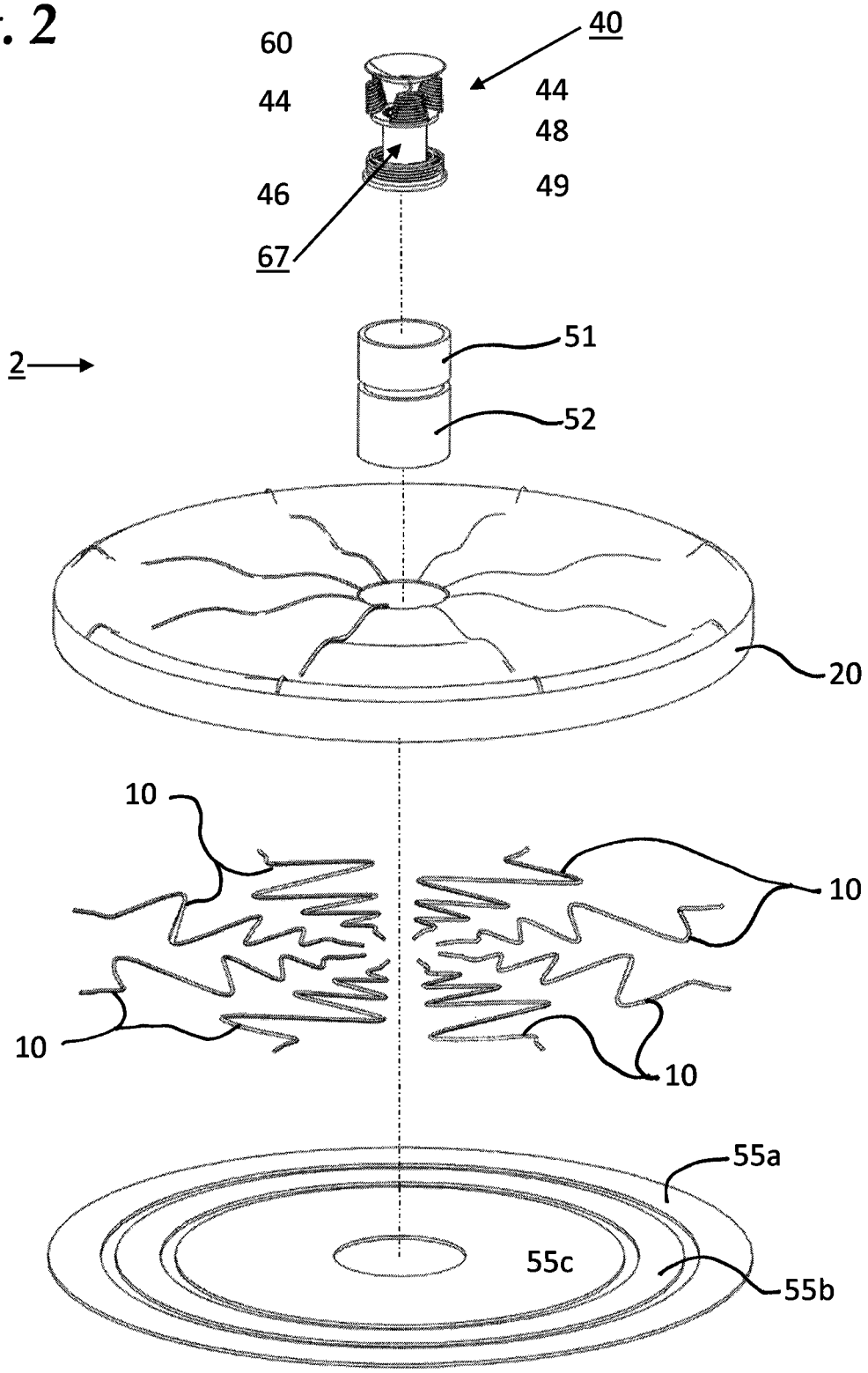
FIG. 2 is an exploded view of the antenna assembly embodiment 2 in stowed configuration.

FIG. 2 shows an exploded view of antenna assembly 2 in stowed configuration. Feed assembly 40 comprises secondary reflector 60 supported by coiled shape memory extendable supports 44 positioned on support ring 46. Telescoping waveguide assembly 67 rests on base 49 and is extended by the action of a coiled shape memory actuator 48.

Bottom heaters 55*a*, 55*b* and 55*c* are positioned below rib elements 10 to controllably heat them for activation.

Figure 3:
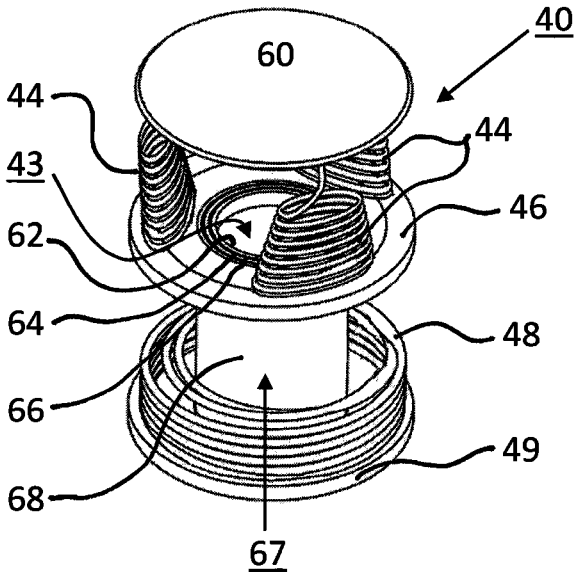
FIG. 3 is a perspective view of the feed assembly 40 in stowed configuration.

FIG. 3 depicts feed assembly 40 in stowed configuration comprising secondary reflector 60 supported by extendable supports 44 which rest on ring 46. Waveguide assembly 67 comprises nesting tubular telescoping elements 62, 64, 66 and 68. Coiled actuator 48 is positioned around waveguide assembly 67 and rests on ring 49. Numeral 43 denotes the lumen of waveguide assembly 67.

Figure 4:
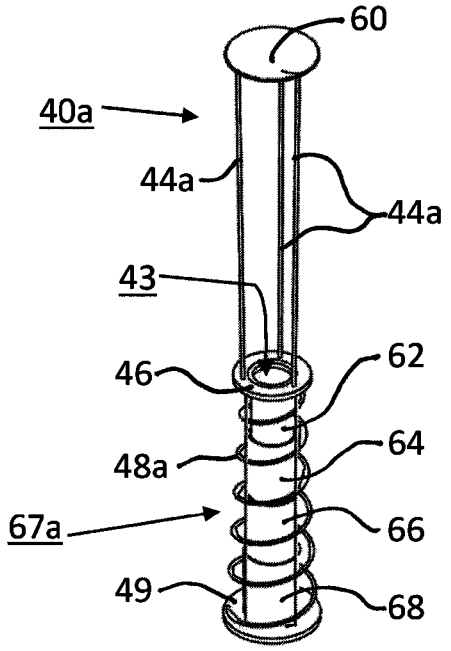
FIG. 4 is a perspective view of the feed assembly 40 in deployed configuration 40*a*.

FIG. 4 depicts feed assembly 40 in its deployed configuration 40*a*. Secondary reflector supports 44 extend to their deployed configuration 44*a* upon application of heat by heater 51 (not shown). Telescopic waveguide assembly 67 is extended into its deployed configuration 67*a* by extended actuator 48 which assumes deployed configuration 48*a* upon application of heat by heater 52 (not shown).

Figure 5:
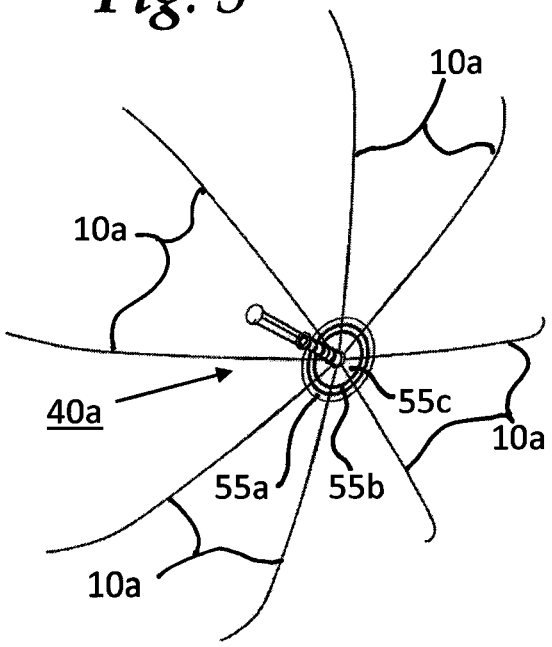
FIG. 5 is a perspective view of the antenna rib elements 10*a* in deployed configuration and feed assembly 40 in deployed configuration 40*a*.

FIG. 5 shows deployed configuration of primary reflector 20 support rib elements 10 of antenna assembly 2 in their deployed configuration 10*a* and their corresponding heaters 55*a*, 55*b* and 55*c*, along with feed assembly 40 in its deployed configuration 40*a*.

Figure 6:
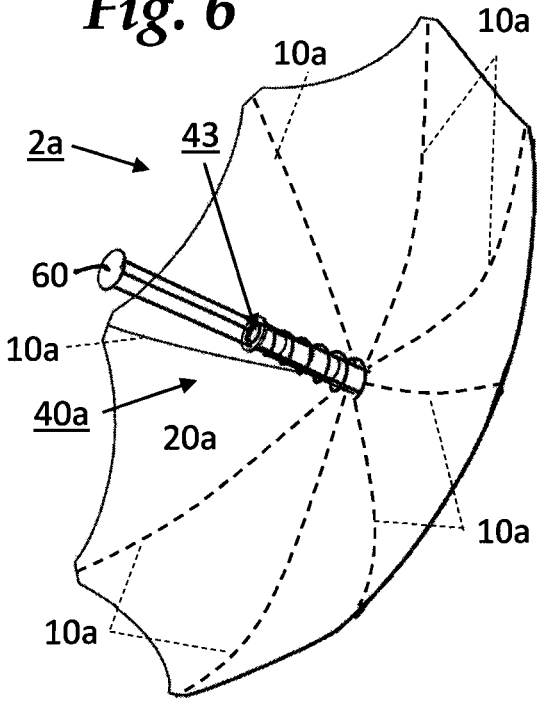
FIG. 6 is a perspective view of the antenna embodiment 2 in deployed configuration 2*a*.
Figure 7:
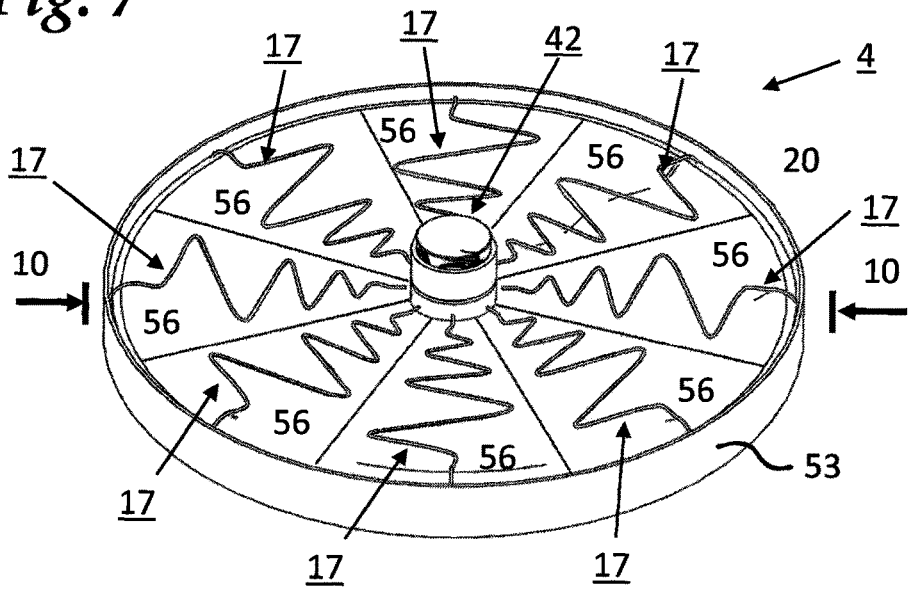
FIG. 7 is a perspective view of the antenna assembly embodiment 4 in stowed configuration.

FIG. 6 shows deployed configuration of antenna assembly 2*a*. The primary reflector rib elements 10 when heated assume extended configuration 10*a* and support primary reflector 20 in its deployed stretched configuration 20*a*. Deployed primary reflector 20*a* is of a paraboloid shape which directs electromagnetic waves to and from secondary reflector 60 which in turn conveys electromagnetic radiation into and out of waveguide lumen 43 of feed assembly 40*a*.

Figure 25:
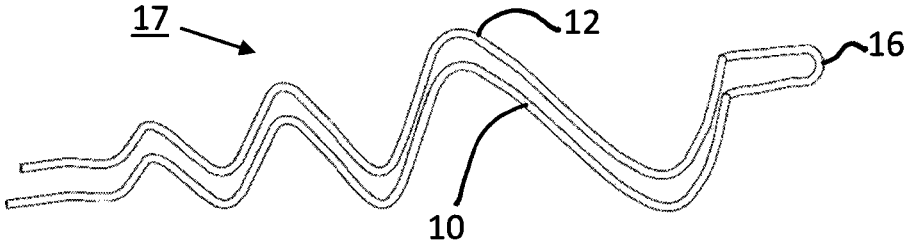
FIG. 25 is perspective view of the antenna rib assembly 17 in stowed configuration.

An alternate antenna assembly 4 is shown on FIGS. 7 through 12. Antenna assembly 4 comprises several folded support rib assemblies 17 extending radially from the central hub/heater 52, each comprising an essentially a C (mathematical symbol for a subset) shape, and each comprising, in addition three sections, namely, 10, 12 and 16 (shown in detail on FIG. 25). Rib elements 10 and 12 in stowed configuration are advantageously folded into meandering trapezoidal shapes to better fit into a circular envelope above and underneath folded primary reflector 20, respectively, to increase packaging density of the antenna assembly. Rib elements 10 and 12 expand radially upon heating, while elements 16 when heated unfold elements 12.

Figure 10:
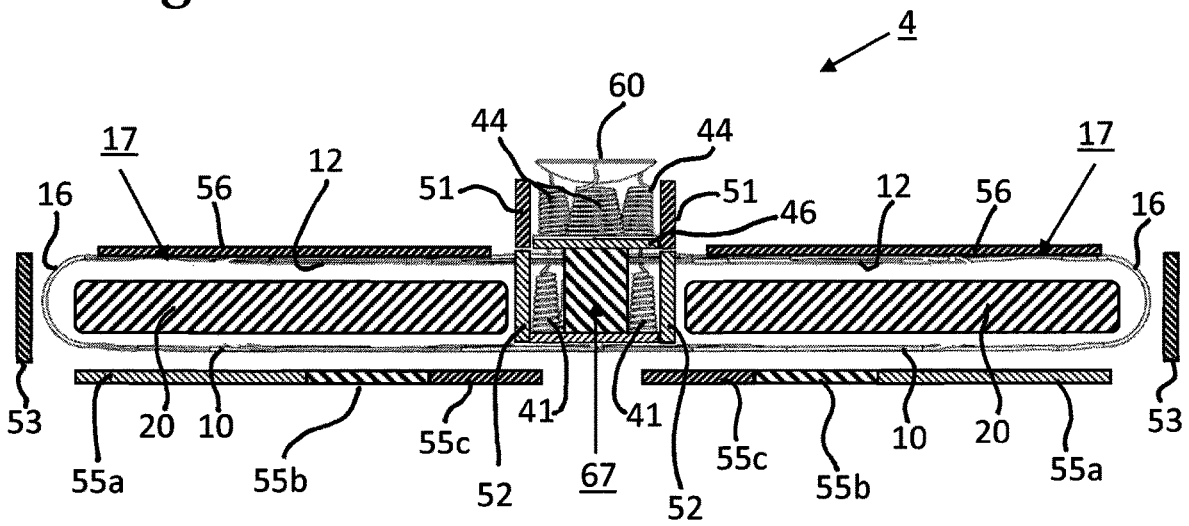
FIG. 10 is a cross section of the antenna assembly embodiment 4 in stowed configuration taken along line 10-10 on FIG. 9.

Referring to FIG. 10, circular side heater 53 heats up rib sections 16, upper heaters 56 unfold with—and heat up rib elements 12. Lower heaters 55*a*, 55*b* and 55*c* heat up rib elements 10 at their distal, middle and proximal sections, respectively. Upper heater 51 heats up secondary reflector supports 44, while lower heater 52 heats up waveguide extension actuators 41.

Figure 11:
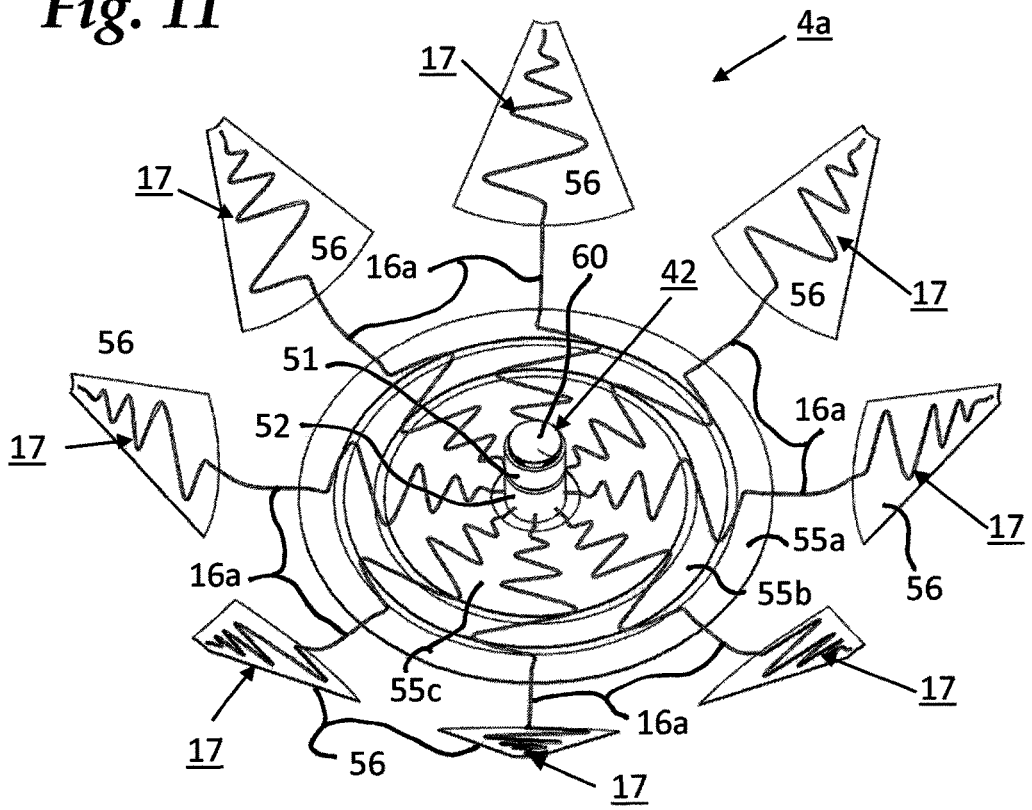
FIG. 11 is a perspective view of the antenna assembly embodiment 4 in partially deployed configuration 4*a*.

FIG. 11 shows a partial deployment of antenna assembly 4*a* upon activation of heater 53 (not shown). Deploying rib elements 16*a* are in the process of positioning rib elements 12 for their subsequent extension by activation by the attached heaters 56. Feed assembly 42 is still in its stowed configuration. The primary flexible reflector 20 is not shown for clarity.

Figure 12:
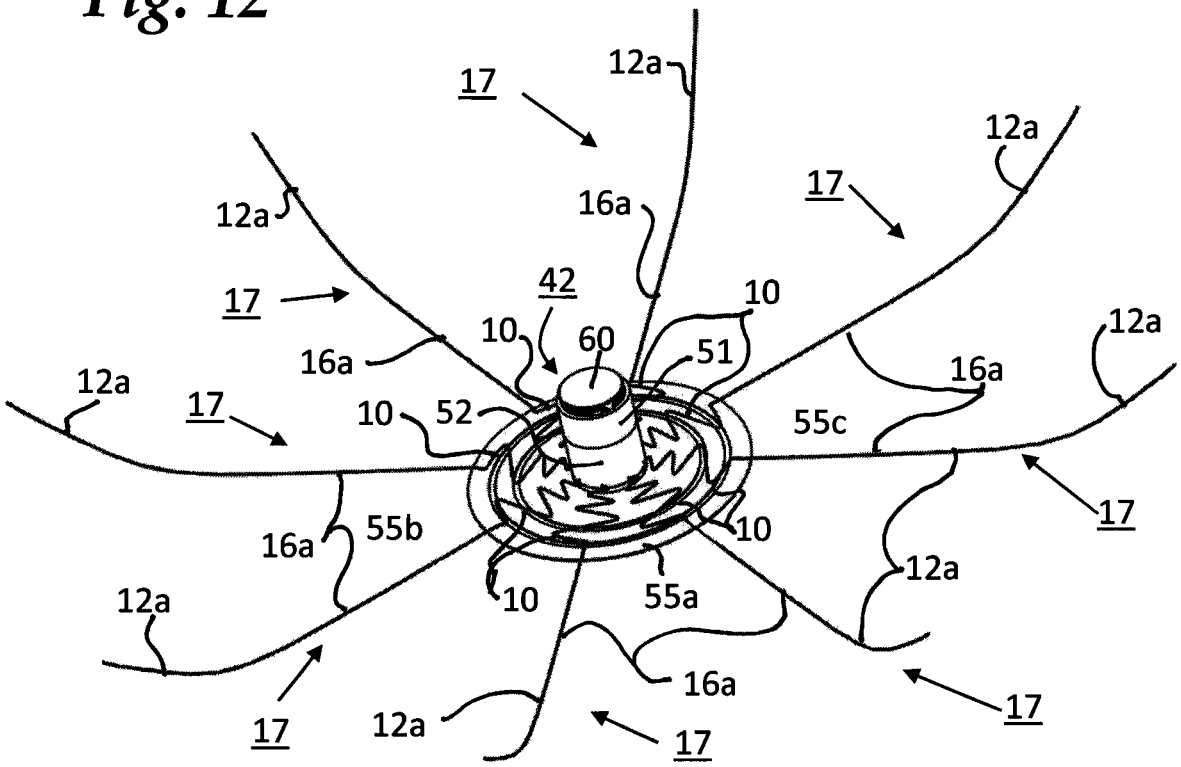
FIG. 12 is a perspective view of the rib assembly of the antenna embodiment 4 in partially deployed configuration.

FIG. 12 depicts partially deployed ribs 17 of antenna assembly 4 (the primary flexible reflector 20 is not shown for clarity), with rib elements 16*a* fully unfolded and elements 12 fully extended into their deployed configuration 12*a* by the action of heaters 53 and 56 respectively. Rib elements 10 are still in the stowed configuration, to be controllably extended by coordinated action of heaters 55*a*, 55*b* and 55*c*.

Figure 8:
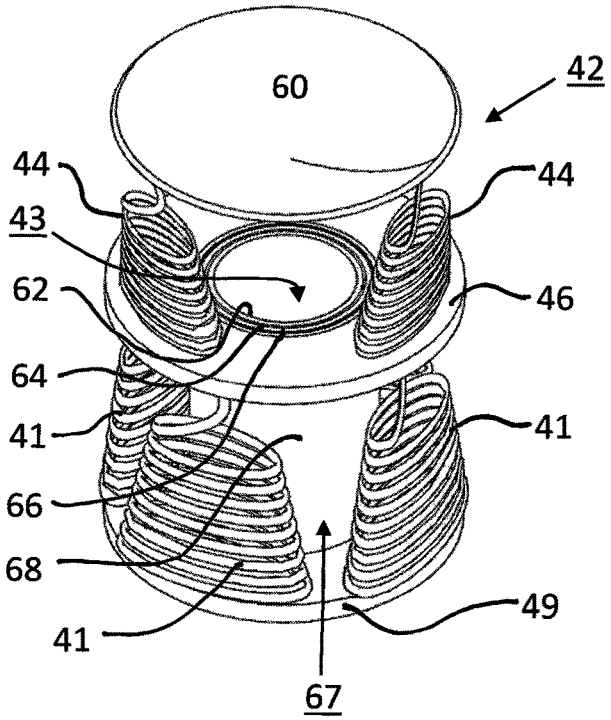
FIG. 8 is a perspective view of the feed assembly 42 in stowed configuration.
Figure 9:
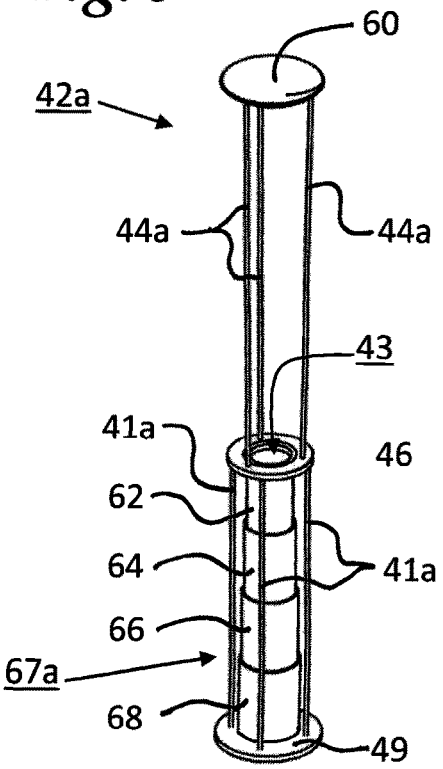
FIG. 9 is a perspective view of the feed assembly 42 in deployed configuration 42*a*.

FIG. 8 depicts feed assembly 42 which is a variant of feed 40, comprising secondary reflector 60 supported by extendable supports 44 which rest on ring 46. Telescopic waveguide assembly 67 comprising telescoping elements 62, 64, 66 and 68 rests on ring 49. Coiled actuators 41 extend waveguide 67 into its deployed configuration 67*a* depicted on FIG. 9. On the same figure secondary reflector 60 supports assume their deployed configuration 44*a* and so do waveguide actuators in their respective deployed configuration 41*a*.

Feed assembly 42 can be deployed independently of ribs 17 by actions of heaters 51 and 52.

Figure 13:
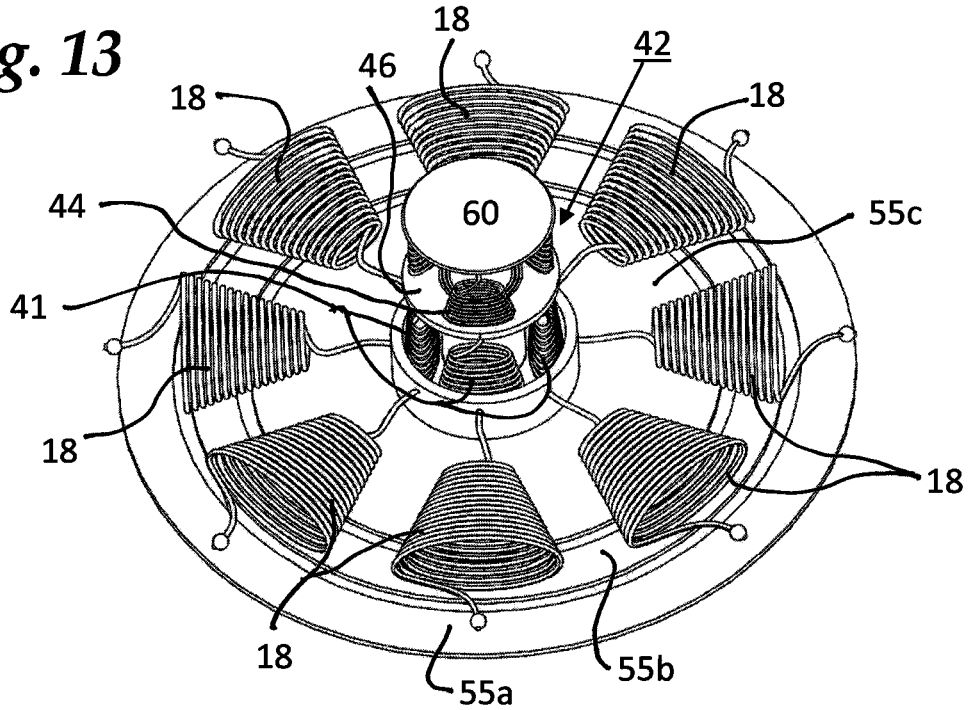
FIG. 13 is a partial perspective view of the support rib assembly of the antenna embodiment 6 in stowed configuration.
Figure 14:
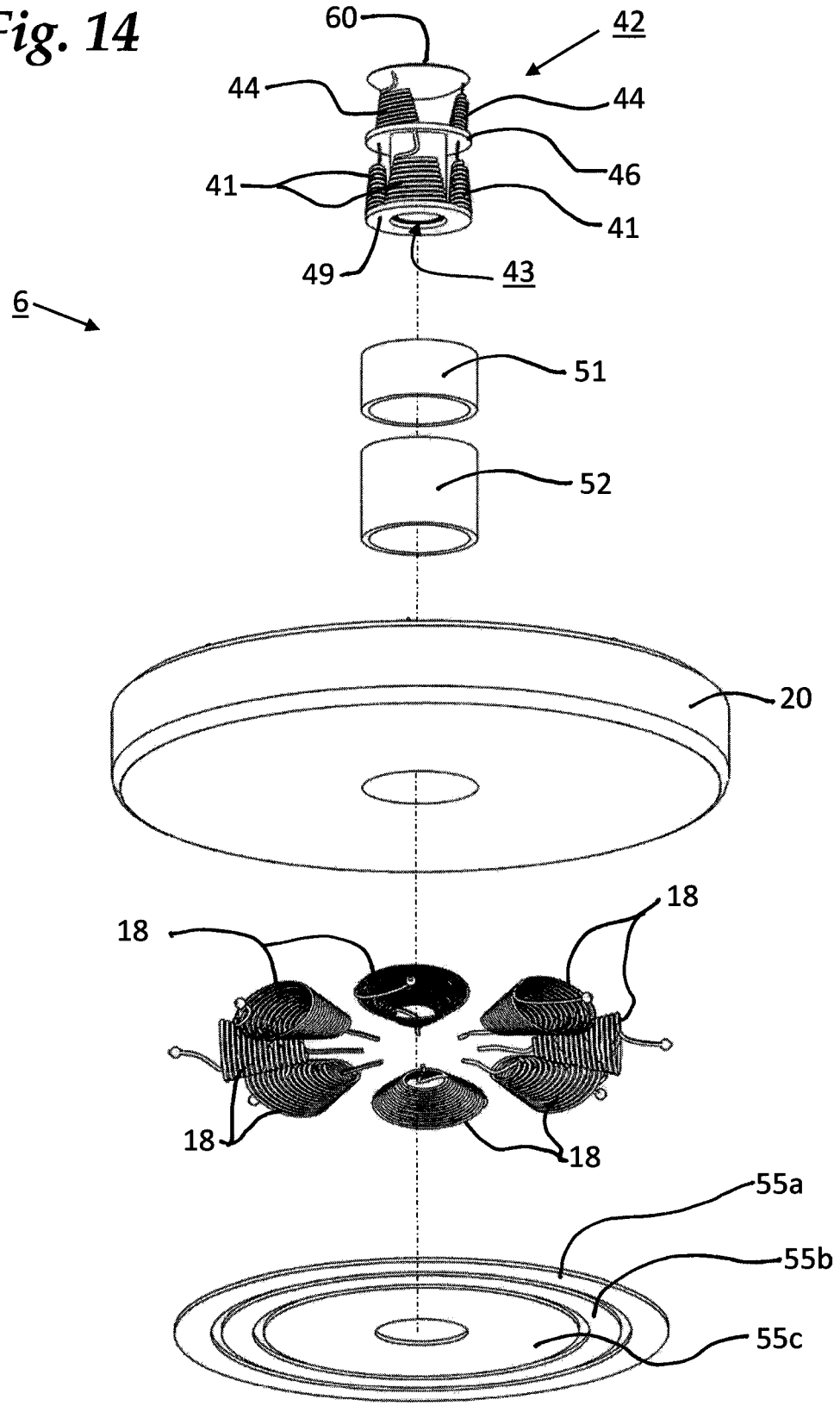
FIG. 14 is an exploded view of the antenna assembly embodiment 6 in stowed configuration.

An alternative antenna system embodiment 6 is illustrated on FIGS. 13 and 14. FIG. 14 shows an exploded view of antenna system 6 which incorporates feed assembly 42 supporting secondary reflector 60. Instead of the flatly stowed ribs 17 of embodiments 2 and 4, deployable ribs 18 are coiled instead. Coiling of the ribs for storage provides a smaller footprint for the assembly, at the cost of an extended height. Coiled ribs 18 in addition are advantageously made to have a generally conical shape, to fully utilize the available circular envelope on top of heaters 55*a*, 55*b* and 55*c*. FIG. 13 shows partial view of assembly 6 depicting coiled ribs 18, with main reflector 20 not shown for clarity.

Figure 15:
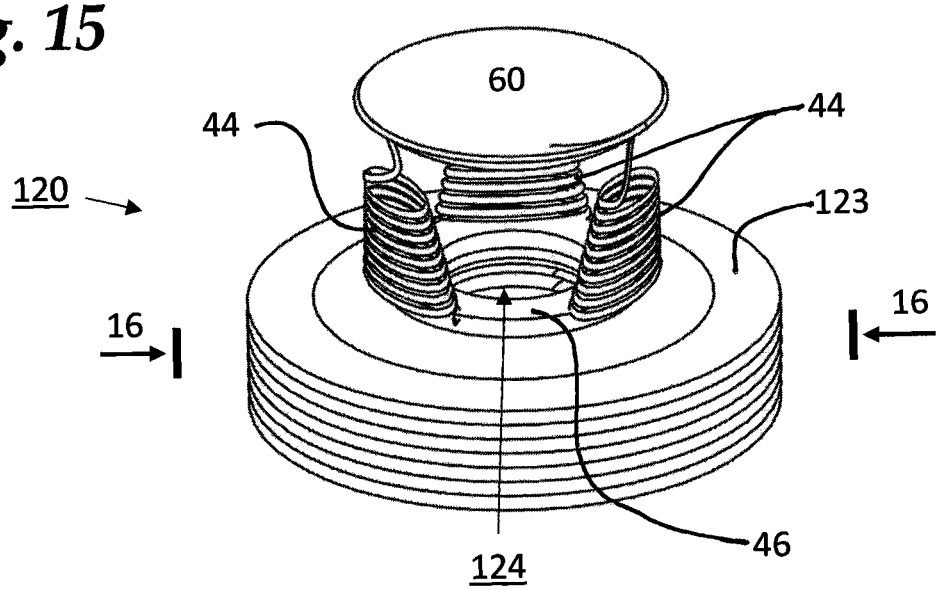
FIG. 15 is a perspective view of the corrugated feed assembly 120 in stowed configuration.
Figure 16:
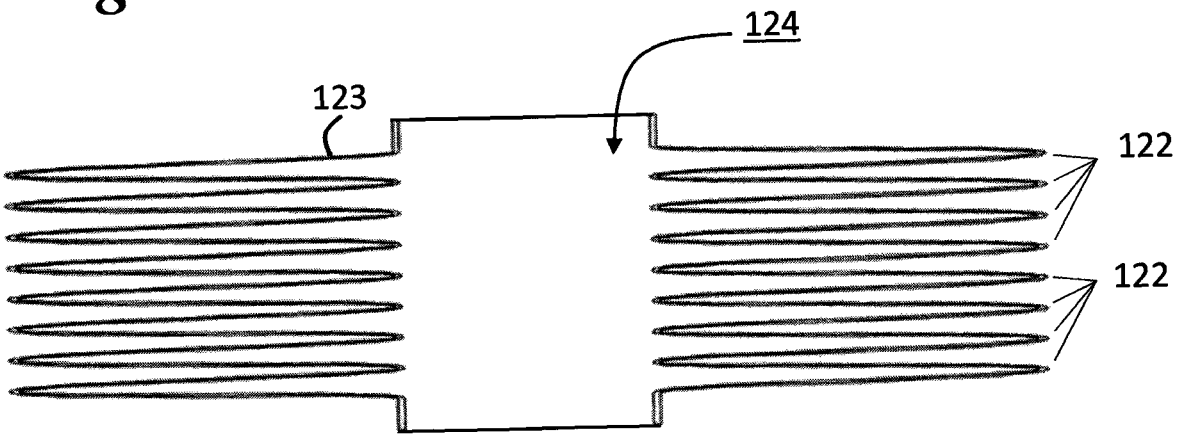
FIG. 16 is a cross section of the corrugated waveguide 123 taken along the line 16-16 on FIG. 15.

An alternative, single-piece feed assembly 120 with waveguide 123 made from a shape memory material is shown on FIG. 15. Waveguide 123 is shown in cross section on FIG. 16. It comprises pleats 122 and lumen 124.

Figure 18:
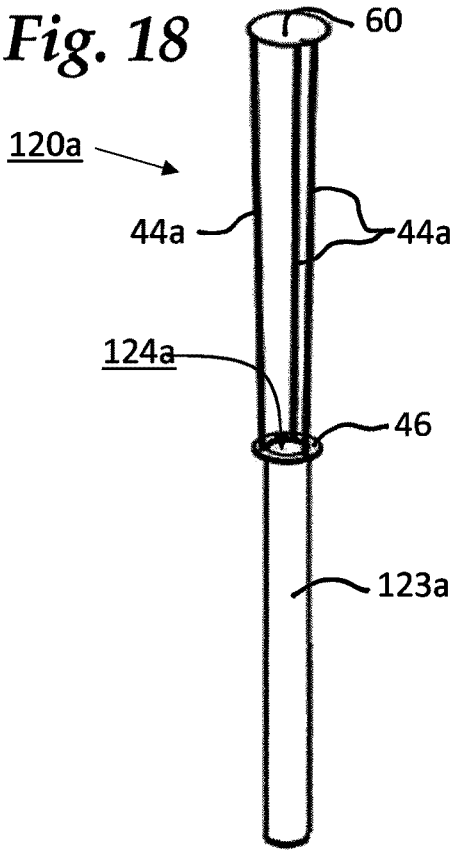
FIG. 18 is perspective view of the feed assembly 120 in deployed configuration 120*a*.

Referring to FIG. 18 extendable supports 44, which rest on ring 46 and support secondary reflector 60, expand to their deployed configuration 44*a* upon being heated by upper heater 51 (not shown). Waveguide 123 expands and assumes its deployed configuration 123*a* comprising lumen 124*a* upon being heated by upper heater 52 (not shown).

Figure 17:
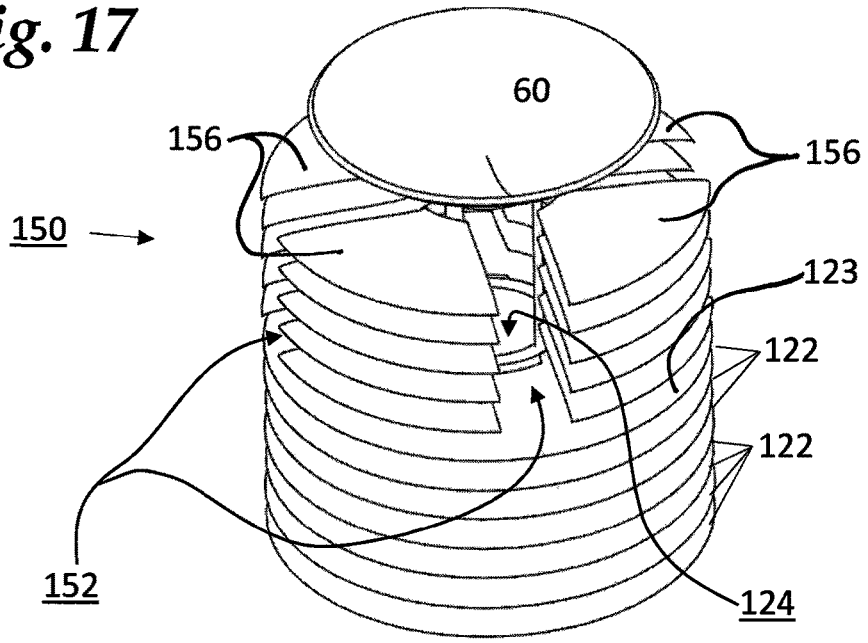
FIG. 17 is a perspective view of the corrugated feed assembly 150 in stowed configuration.
Figure 19:
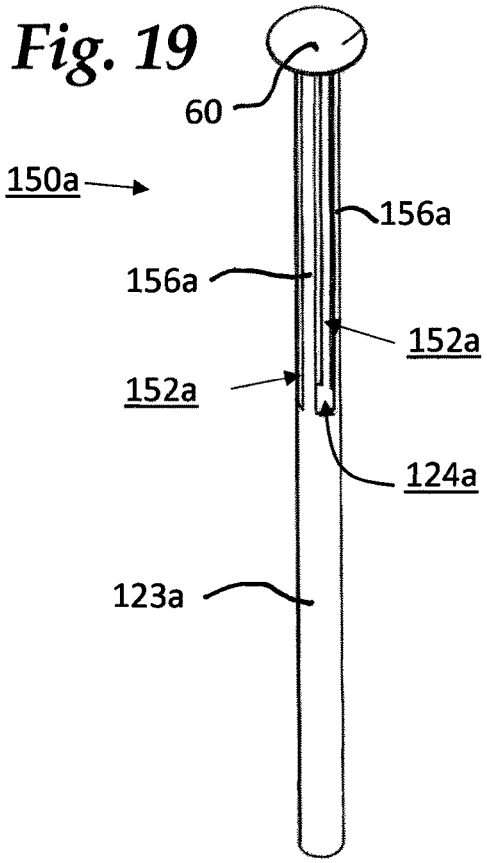
FIG. 19 is perspective view of the feed assembly 150 in deployed configuration 150*a*.

An alternative, single-piece feed assembly 150 is shown on FIG. 17. Referring to FIG. 19 upon application of heat by heaters 51 and 52 (not shown) feed assembly 150 assumes its deployed configuration 150*a*. Waveguide 123, reflector supports 156 and slots 152 transform into their respective deployed configurations 123*a*, 156*a* and 152*a*. Slots 152*a* permit electromagnetic energy to reach secondary reflector 60 upon being reflected off deployed primary reflector 20*a* (not shown), or for the electromagnetic energy to reach reflector 20*a* upon exiting waveguide lumen 124*a* and being reflected off secondary reflector 60.

A yet another alternative antenna system embodiment 8 is shown on FIGS. 20 through 24. Antenna system 8 is close in construction to embodiment 4, with the difference being the supports for secondary reflector 60.

Figure 21:
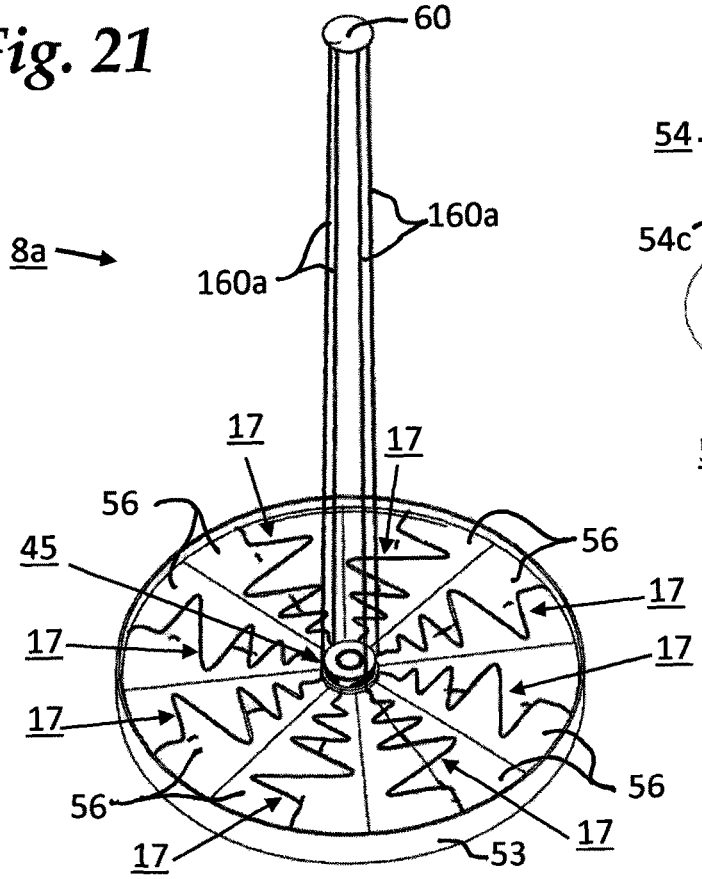
FIG. 21 is perspective view of the antenna assembly 8 in partially deployed configuration 8*a*.
Figure 23:
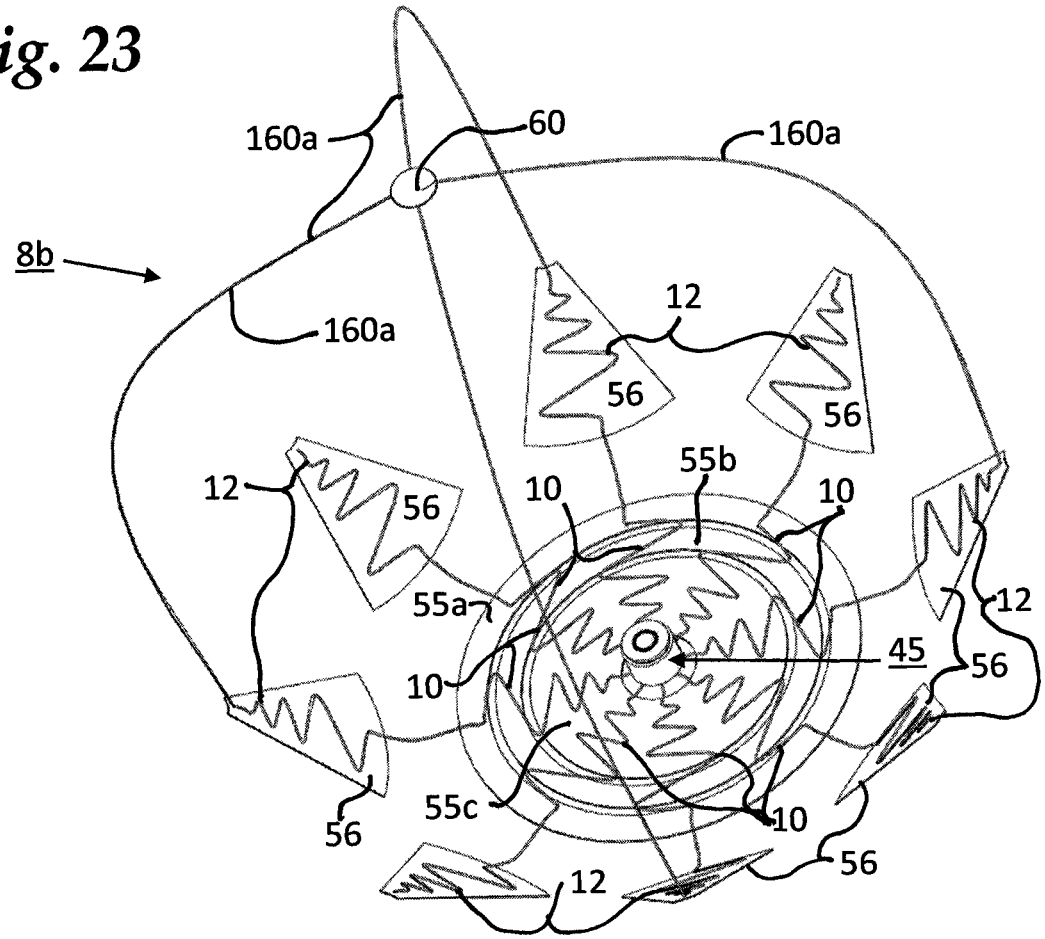
FIG. 23 is perspective view of the antenna assembly 8 in partially deployed configuration 8*b*.

Referring to FIGS. 21 and 23, in contrast to the previous 2, 4 and 6 antenna embodiments, in embodiment 8 instead of the waveguides, secondary reflector 60 supports 160 are connected to distal ends of ribs elements 12 of ribs 17. Supports 160 extend from their stowed configuration to their intermediate extended configuration 160*a* upon being heated by heater assembly 54, for the partial deployment configuration of antenna system 8*a* depicted on FIG. 21.

On FIG. 23, upon deployment of supports 160 to their intermediate configuration 160*a* rib elements 16 of ribs 17 unfold upon being heated by heater 53 and place antenna assembly into its intermediate configuration 8*b*. In this configuration supports 160*a* resiliently bend to accommodate the movement of rib elements 12.

Figure 24:
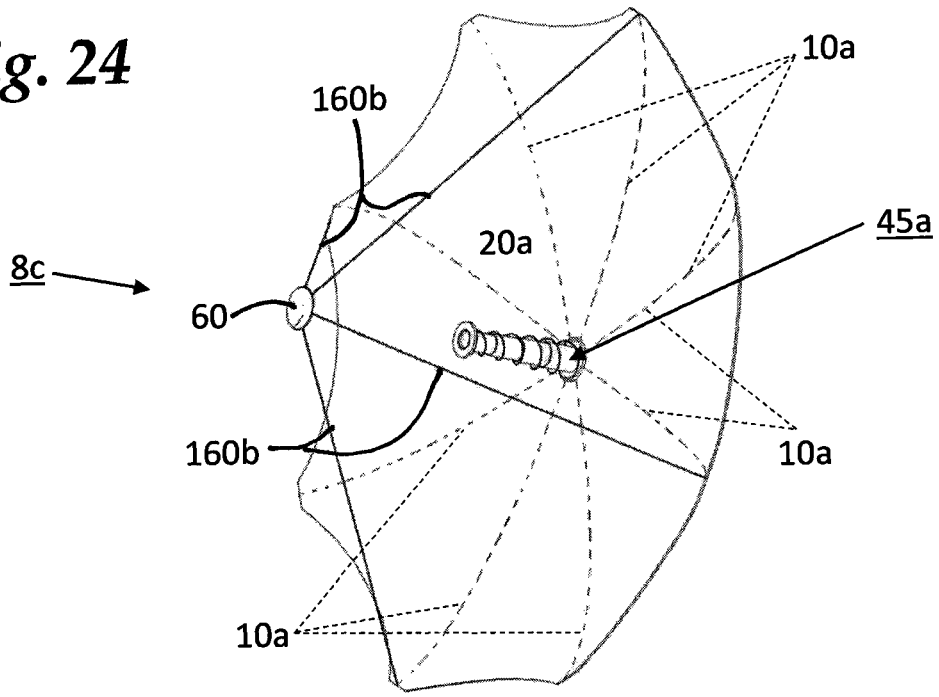
FIG. 24 is perspective view of the antenna assembly 8 in fully deployed configuration 8*c*.

On FIG. 24, when rib elements 12 (not shown) are fully extended by being heated by heaters 56 (not shown), rib elements 10 extend to their deployed configuration 10*a* by being heated by heaters 55*a*, 55*b* and 55*c* (not shown), and feed assembly 45 is extended to its deployed configuration 45*a* by being heated by heater 52 (not shown), deployed supports 160*a* assume their fully deployed configuration 160*b* and position secondary reflector 60 to face the deployed paraboloid primary reflector 20*a* and feed 45*a*, thus transforming antenna system 8 into its fully deployed configuration 8*c*.

Figure 20:
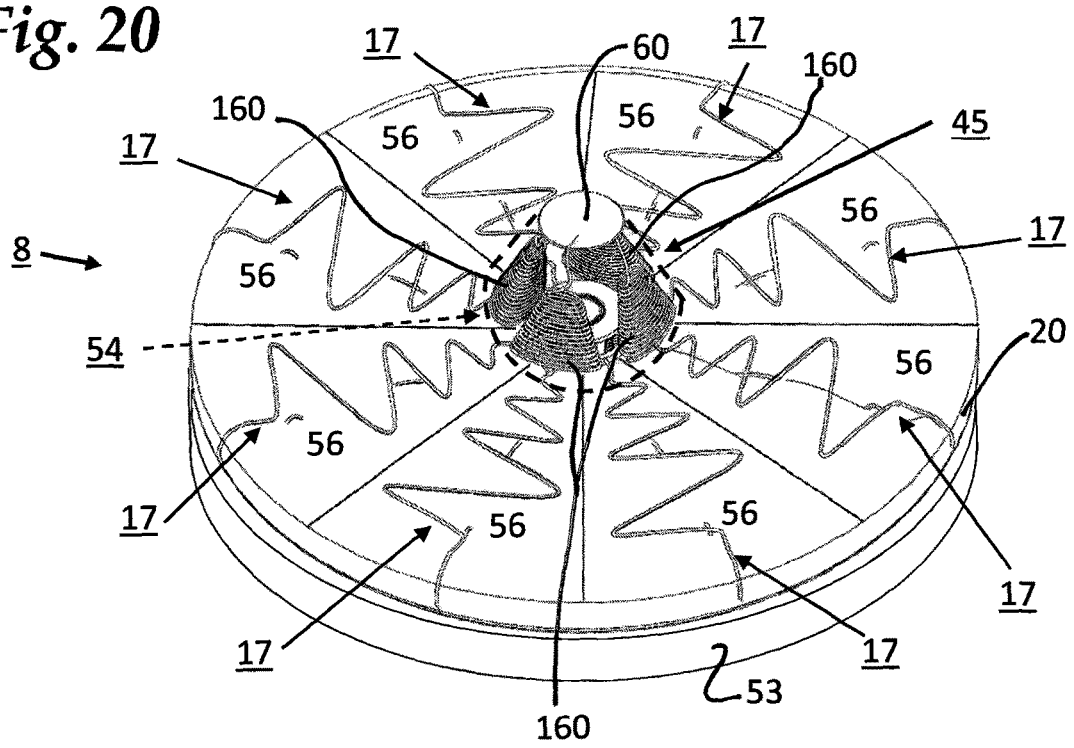
FIG. 20 is perspective view of the antenna assembly 8 in stowed configuration.
Figure 22:
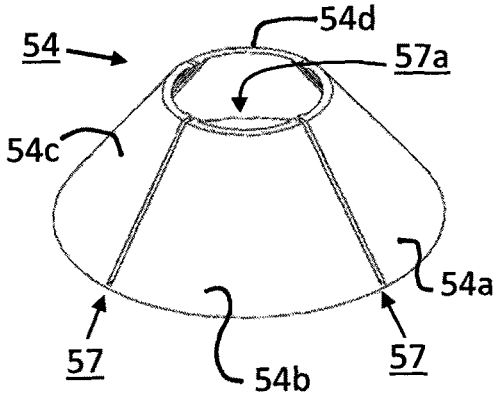
FIG. 22 is perspective view of the heater assembly 54.

Referring to FIG. 20, supports 160 are of the coiled type, are connected to their respective rib 12 distal endpoints, and are heated by heater assembly 54 shown on FIG. 22. Heater assembly 54 is frusto-conical in shape with aperture 57*a* at its apex to accommodate secondary reflector 60 and fits on top of stowed coiled supports 160 when installed in the assembly and is shown in broken line on FIG. 20.

Referring again to FIG. 22, heater assembly 54 further comprises heating elements 54*a*, 54*b*, 54*c* and 54*d* which are partially separated from each other by slots 57. When activated, supports 160 extend through slots 57 to deploy reflector 60. The connections between individual heating elements 54*a*, 54*b*, 54*c* and 54*d* are made to fracture when primary reflector support ribs 17 deploy, so as not to impede their unfolding.

Feed 45 is identical to feed 40 with the exception of absence of supports 44.

Figure 26:
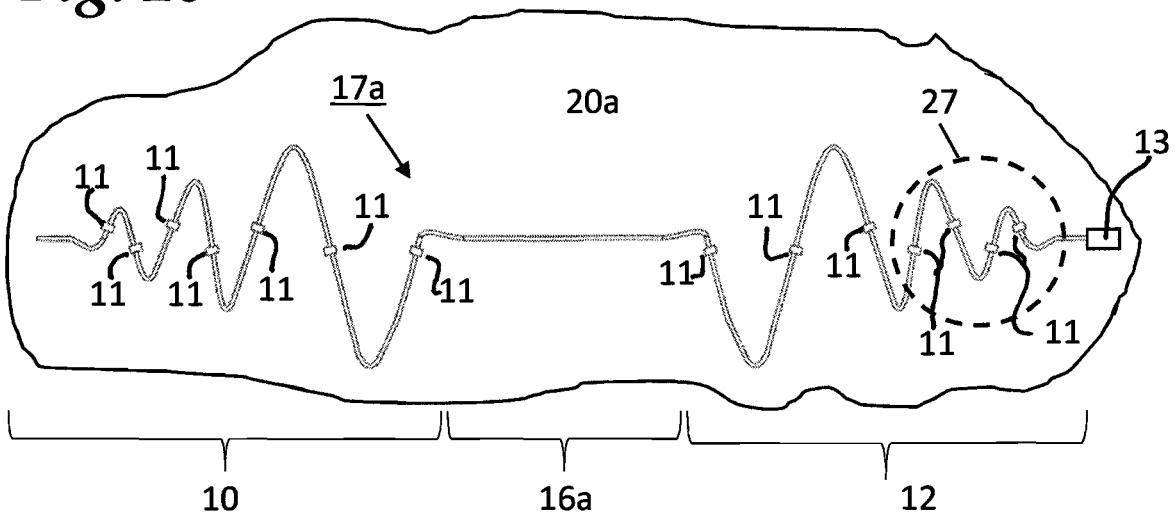
FIG. 26 is a plan view of the antenna rib assembly 17 in partially deployed configuration 17*a*.
Figure 27:
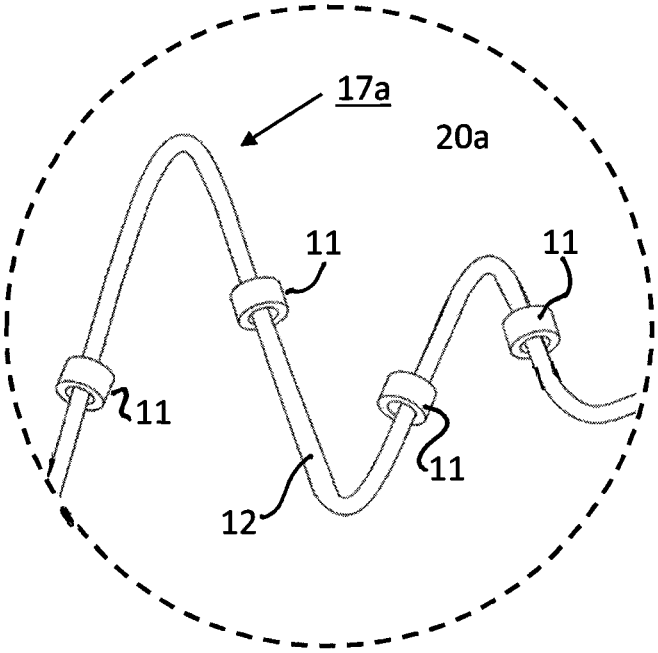
FIG. 27 is a fragmentary magnified plan view of the area 27 on FIG. 26.

Referring to FIGS. 26 and 27, coupling rings 11 are connected to flexible reflector 20 and are allowed to slide along ribs 17 during deployment of antenna system. Proximal ends of rib elements 10 are permanently connected to heater assembly 52 while rib elements 12 are allowed to extend radially and outwardly while connected on their distal ends to capture devices 13 fixed to reflector 20. When ribs 17 expand radially upon application of heat they stretch reflector 20 and impart a paraboloid shape to it.

Figure 31:
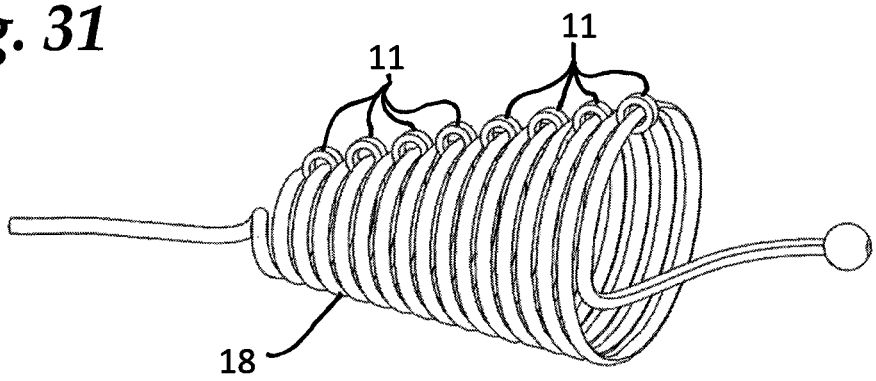
FIG. 31 is perspective view of the antenna coiled rib 18 in stowed configuration.

Coupling rings 11 are also utilized with coiled ribs 18 as shown on FIG. 31.

Figure 28:
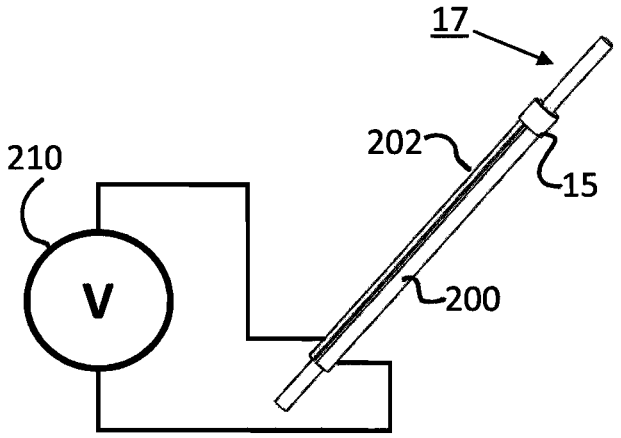
FIG. 28 is a schematic of the direct electrical heating system for rib assemblies 17.

Referring to FIG. 28, each rib 17 has on it has dedicated heater elements 200 and 202 connected by an electrical contact 15. Electric current generated by external voltage source 210 heats up heaters 200 and 202 and through them rib 17 facilitating its deployment.

Figure 29:
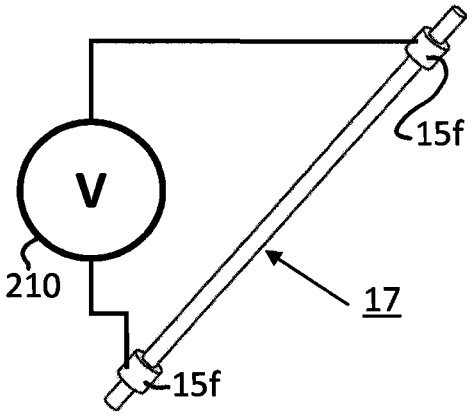
FIG. 29 is a schematic of an alternative direct electrical heating system for rib assemblies 17.

On FIG. 29 ribs 17 are directly heated by passing through them electric current generated by external voltage source 210. Contacts 15*f* provide electrical connection from source 210 to rib 17. Shape memory materials utilized for ribs 17, such as metallic Ni-based alloys are advantageously suited for this, as they possess high electrical resistivity.

Figure 30:
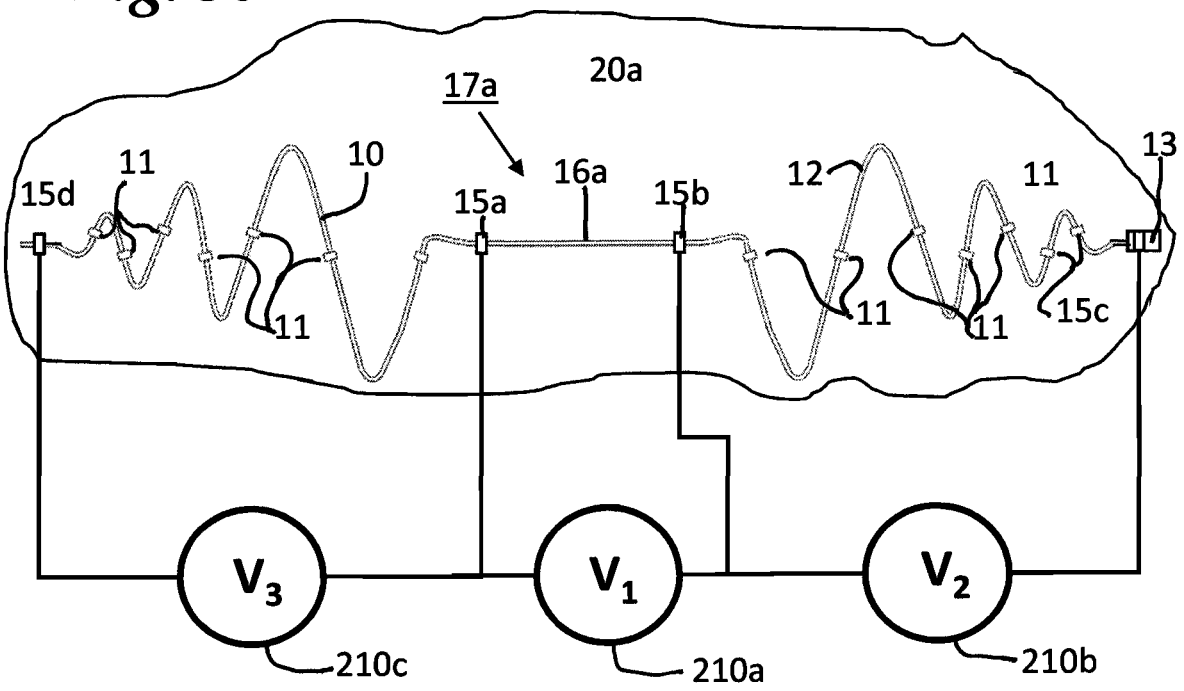
FIG. 30 is a schematic of a segmented electrical direct heating system of the rib assemblies 17.

FIG. 30 shows rib 17 in partial deployment configuration 17*a* after rib element 16 has been directly heated by electric current supplied by voltage source 210*a* to assume its deployed configuration 16*a*. Source 210*a* is connected to rib 17 by contacts 15*a* and 15*b*. This rib configuration generally corresponds to antenna embodiment configuration 4*a* on FIG. 11.

Also on FIG. 30 external voltage sources 210*b* and 210*c* connect to rib 17's elements 12 and 10 by contacts 15*b*-15*c*, and 15*a*-15*d*, respectively.

When ribs 17 are to be directly electrically heated, in antenna embodiments 2, 4, 6, 8 and 9, heaters 53, 56, 55*a*, 55*b* and 55*c* are not required. In embodiment 9, in addition, heater 54 is not required either.

Likewise, direct electrical heating can be used for feed deployment, obviating feed deployment heaters 51 and 52 or, again, 54 (used for feed 180 of embodiment 10).

Figure 35:
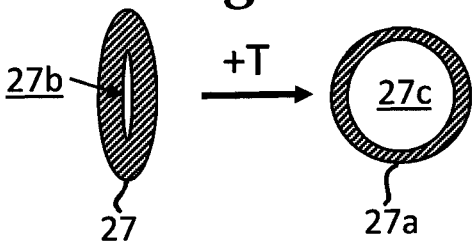
FIG. 35 is a cross section of an expandable cylindrical hollow element possible with shape memory materials upon heating.
Figure 34:
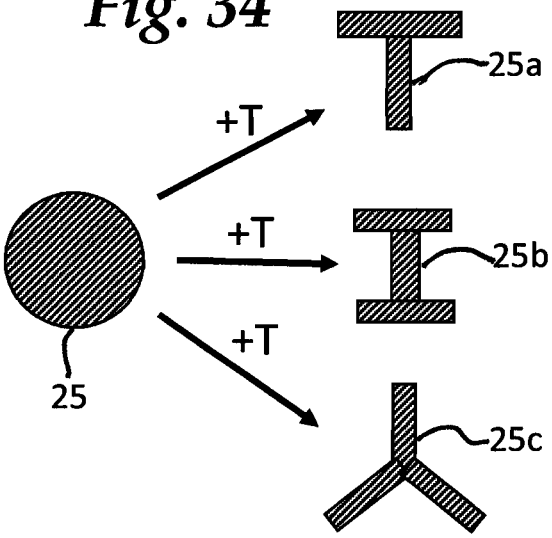
FIG. 34 are cross sections of solid ribs 17 possible with shape memory materials upon heating.
Figure 36:
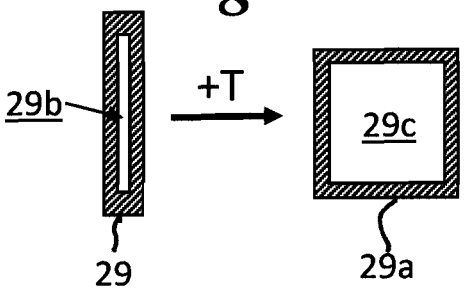
FIG. 36 is a cross section of an expandable rectangular hollow element possible with shape memory materials upon heating.

Referring to FIGS. 34 through 36, ribs 17, supports 44 and 160, and feed actuators 41 can have cross sections optimized both for storage and for deployment. Mark '-FT' denotes application of heat for transformation.

For example, per FIG. 34, a rib can have round cross section 25 optimized for storage and coiling, while it would transform upon deployment into a 'T-beam', 'I-beam' or a tri-lobe configurations, 25*a*, 25*b* and 25*c*, respectively which would offer increased stiffness in certain directions vs. the rib of the original cross-section.

Referring to FIGS. 35 and 36, ribs 27 and 29, respectively, having hollow oblong cross sections can be made pliable in the direction perpendicular to their thickness, which would facilitate their folding or winding for efficient storage. Upon deployment, however, their cross sections can be transformed into stiffer, more symmetric forms, such as 27*a* and 29*a*, respectively, which would be optimized for deployment and would open up their lumens 27*b* and 29*b* to 27*c* and 29*c* respectively.

Figure 37:
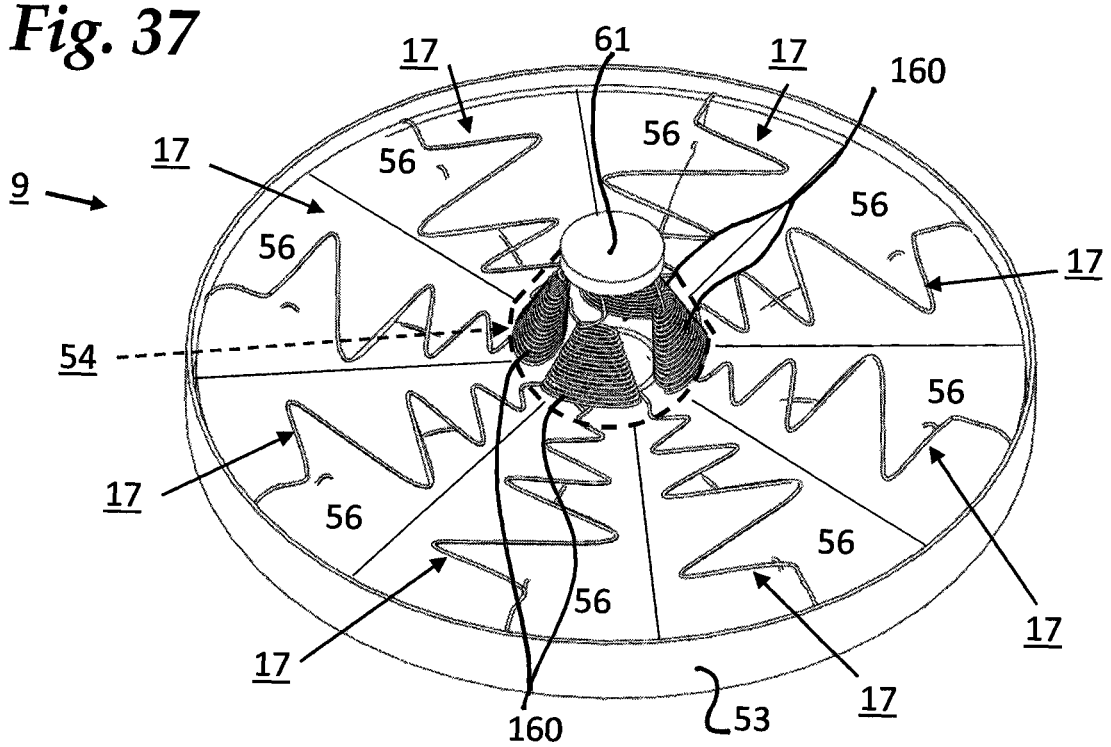
FIG. 37 is perspective view of the antenna assembly 9 in stowed configuration.
Figure 38:
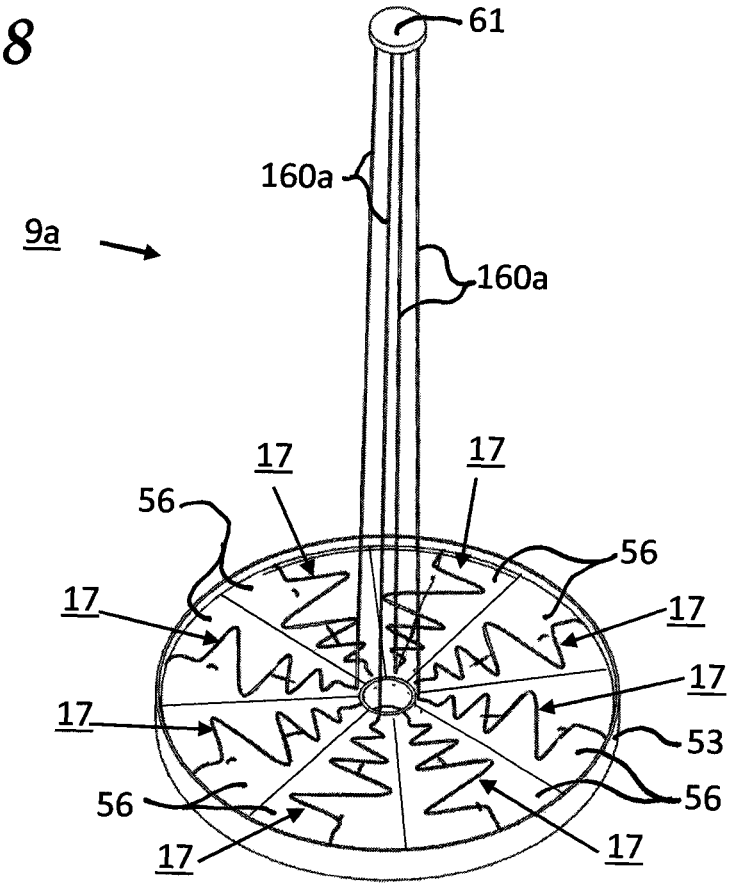
FIG. 38 is perspective view of the antenna assembly 9 in partially deployed configuration 9*a*.
Figure 39:
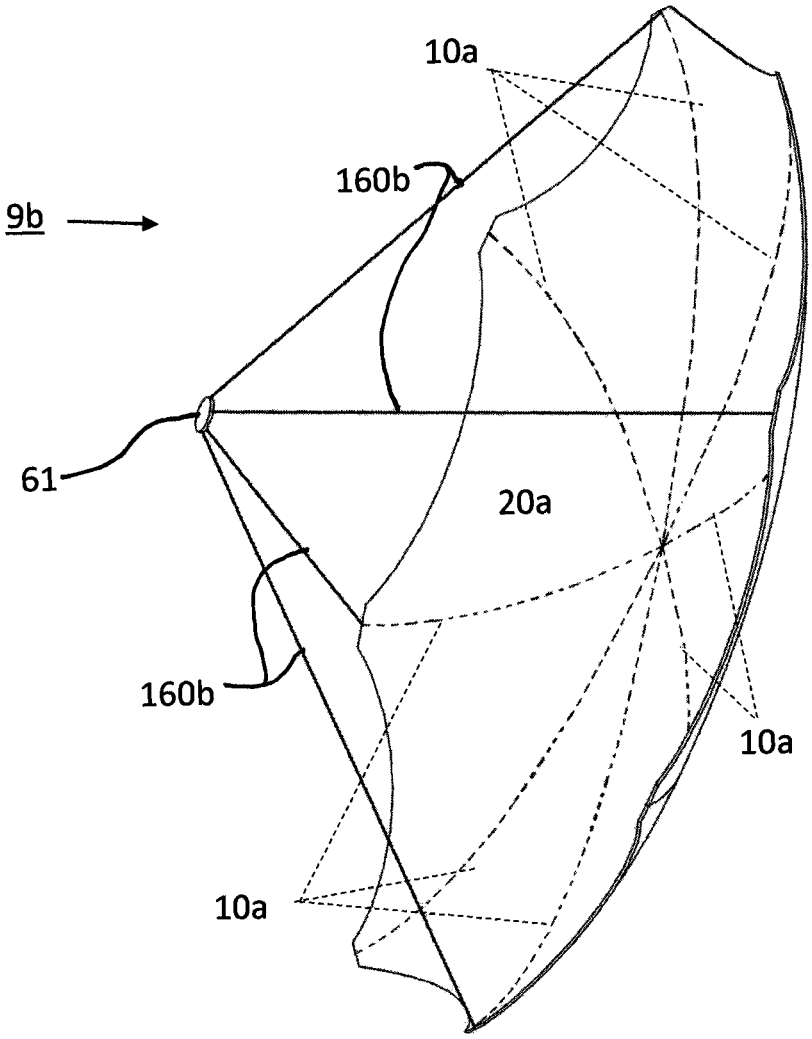
FIG. 39 is perspective view of the antenna assembly 9 in fully deployed configuration 9*b*.
Figure 40:
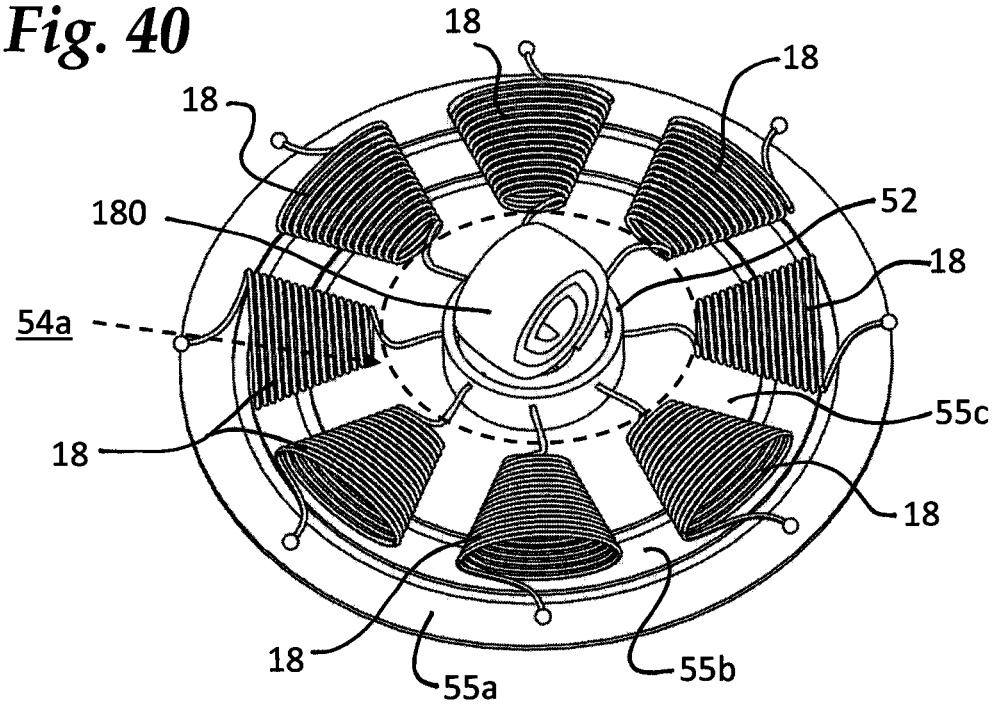
FIG. 40 is a partial perspective view of the antenna assembly 10 in stowed configuration.
Figure 41:
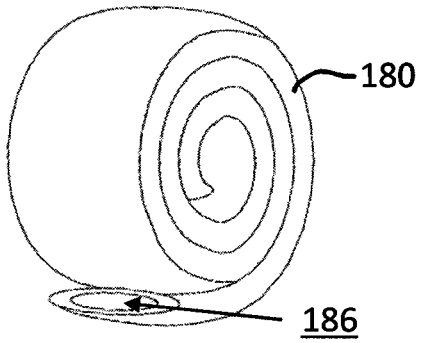
FIG. 41 is a perspective view of the ribbon feed 180 in stowed configuration.
Figure 42:
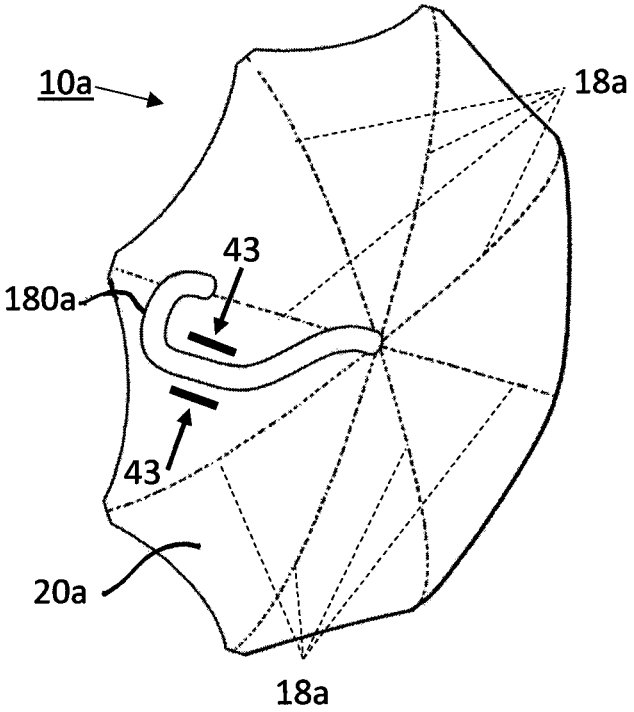
FIG. 42 is perspective view of the antenna assembly 10 in fully deployed configuration 10*a*.
Figure 43:
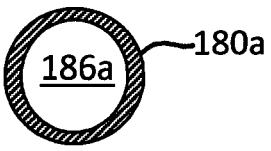
FIG. 43 is a cross section of feed 180 in deployed configuration 180*a* taken along line 43-43 on FIG. 42.

FIGS. 37, 38 and 39 illustrate antenna system 9 which is based on flexible primary reflector 20 supported by ribs 17 but instead of a feed and a secondary reflector has a patch antenna 61 which can be used for both transmitting and receiving. Supports 160 are made of shape memory material and activated by heater 54 (shown in broken line). Also not shown on these figures are annular heaters 55*a*, 55*b*, and 55*c* for rib sections 10 and a radio-frequency cable which would normally connect patch antenna 61 to a transceiver on a satellite. Such cable would be routed from a transceiver to patch 61 along one of supports 160*b*.

An alternative antenna system embodiment 10 is shown on FIGS. 40 through 43. A ribbon feed 180 is spirally wound in its stowed configuration and positioned in the middle of the antenna assembly inside heater 52. It is actuated by heater 52 and extends to its deployed configuration 180*a* shown on FIG. 42. Feed 180*a* assumes a hook-like shape so its distal end is positioned at the focal point of deployed primary reflector 20*a* and faces reflector 20*a*. This configuration obviates the need for a secondary reflector for the antenna system. During actuation feed 180 not only unfurls, but its compressed lumen 186 assumes its deployed round shape 186*a* shown on FIG. 43, which is conducive to transmission of electromagnetic radiation. Primary reflector 20 is transformed into its deployed configuration 20*a* by radial extension of ribs 18 into their deployed configuration 18*a* upon being heated by heaters 55*a*, 55*b*, and 55*c* shown on FIG. 40.

The shape memory materials used in the instant antenna system construction may include shape memory alloys ('SMAs') or shape memory polymers ('SMPs').

Shape memory alloys comprise numerous alloys such as AgCd, AuCd, cobalt-, copper-, iron-, nickel- and titanium-based, with most well-known and used being Cu—Al—Ni and Ni—Ti alloys (the latter known as 'nitinols').

Shape memory polymers comprise linear block polymers such as polyurethanes, polyurethanes with ionic or mesogenic components made by prepolymer method, block copolymer of polyethylene terephthalate (PET) and polyethyleneoxide (PEO), block copolymers containing polystyrene and poly(1,4-butadiene), and an ABA triblock copolymer made from poly(2-methyl-2-oxazoline) and polytetrahydrofuran.

Also, cross-linked PEO-PET block copolymers and PEEK can be used as shape memory elements of instant invention.

Some of these SMPs can be made to contain carbon which makes them electrically conductive. This conductivity can be advantageous for their direct heating with electrical current and the reflectance of the antenna dish made from them.

Operational Details

The deployment sequences of several embodiments of instant antenna systems are shown on FIGS. 44 through 49.

The controlled deployment sequences of antenna system elements ensure reliable deployment of the antenna and its achieving its reflector desired paraboloid shape 20*a*, and proper deployment and positioning of the feed, secondary reflector 60 or patch antenna 61.

Figure 44:
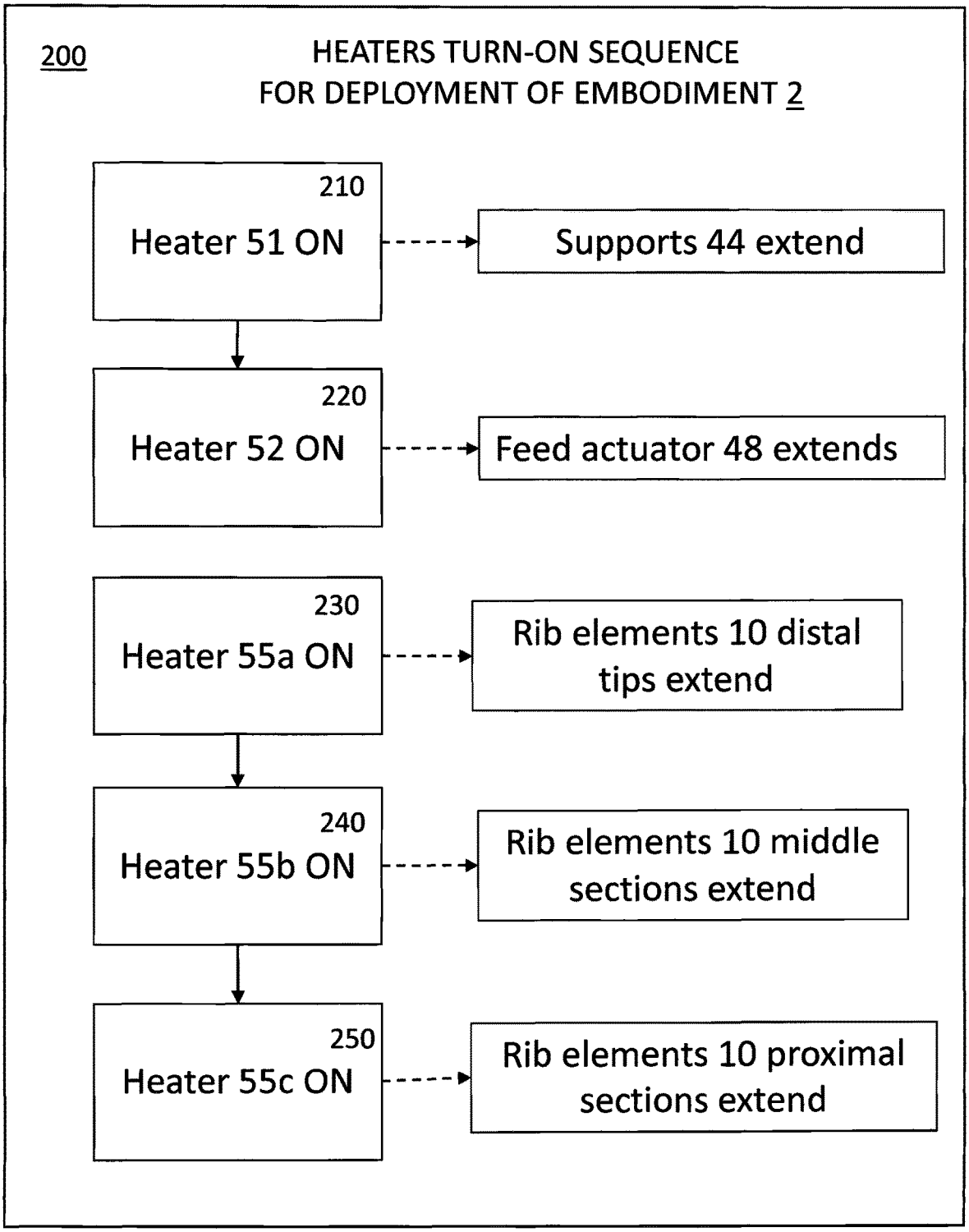
FIG. 44 is a diagram of the heaters activation sequence for antenna system embodiment 2.

Referring to FIG. 44, in sequence 200 which pertains to antenna system 2, supports 44 and feed 40 are extended by activating heaters 51 and 52 (steps 210 and 220) respectively. The rib elements 10 are extended by a timed action of heaters 55*a*, 55*b* and 55*c*: first the distal tips of rib elements 10 are activated by heater 55*a* (step 230), then their middle sections activated by heater 55*b* (step 240), and finally their proximal ends activated by heater 55*c* (step 250). This sequence ensures reliable deployment of the flexible primary reflector 20 from the stored configuration outwards, to form a paraboloid reflector 20*a*.

Figure 45:
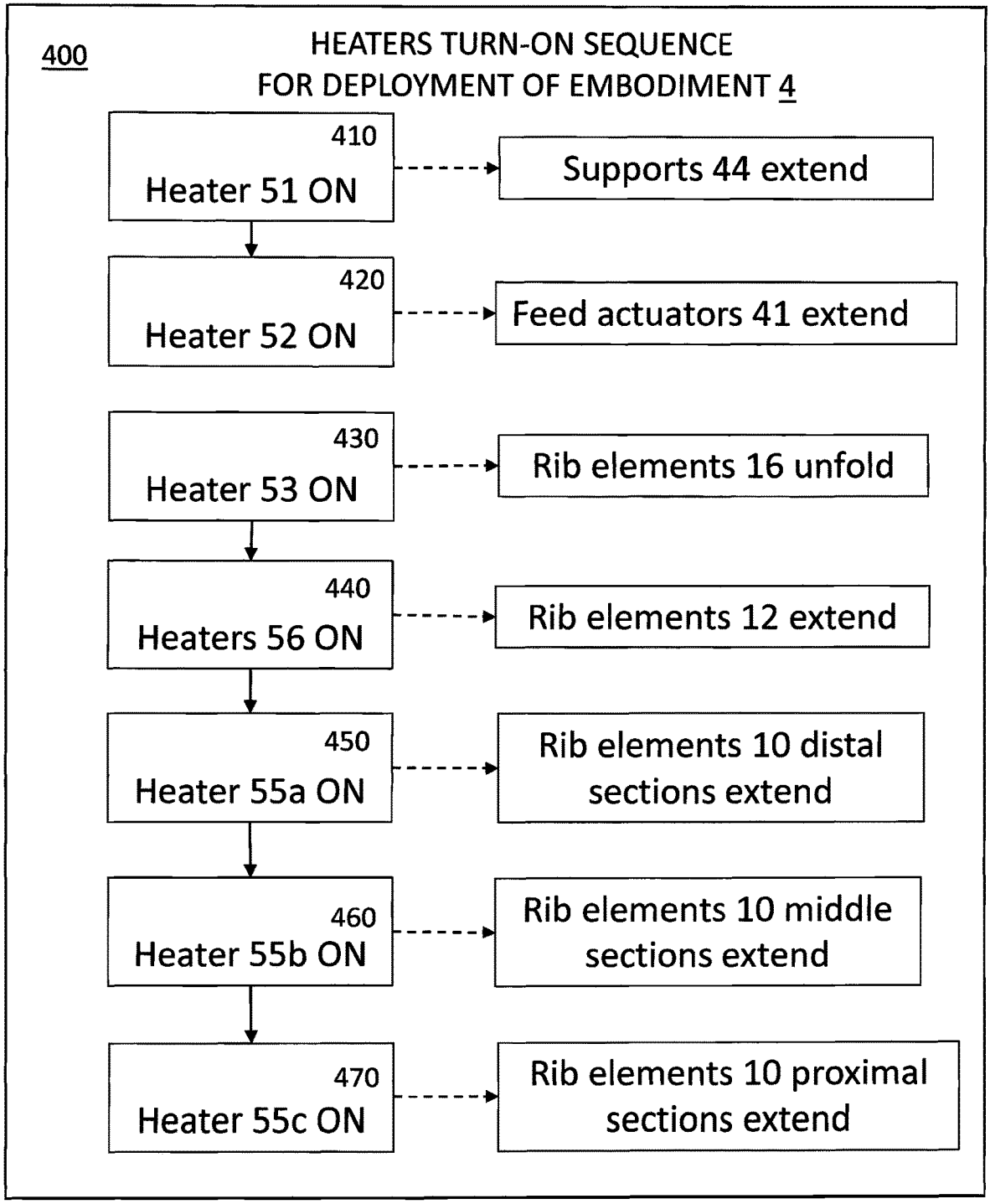
FIG. 45 is a diagram of the heaters activation sequence for antenna system embodiment 4.

Referring to FIG. 45, in sequence 400 which pertains to antenna system 4, supports 44 and feed 42 are extended by activating heaters 51 and 52 (steps 410 and 420) respectively. Rib elements 16 are activated by heater 53 and unfold elements 12 and their heaters 56 (step 430). Rib elements 12 radially extend as heaters 56 are turned on (step 440). The rib elements 10 are then controllably extended radially by a timed action of heaters 55*a*, 55*b* and 55*c*: first the distal tips of rib elements 10 are activated by heater 55*a* (step 450), then their middle sections activated by heater 55*b* (step 460), and finally their proximal ends activated by heater 55*c* (step 470). Just like in the previous embodiment, this sequence ensures reliable deployment of the flexible primary reflector 20 from its stowed configuration outwards, to form a paraboloid reflector 20*a*.

Figure 46:
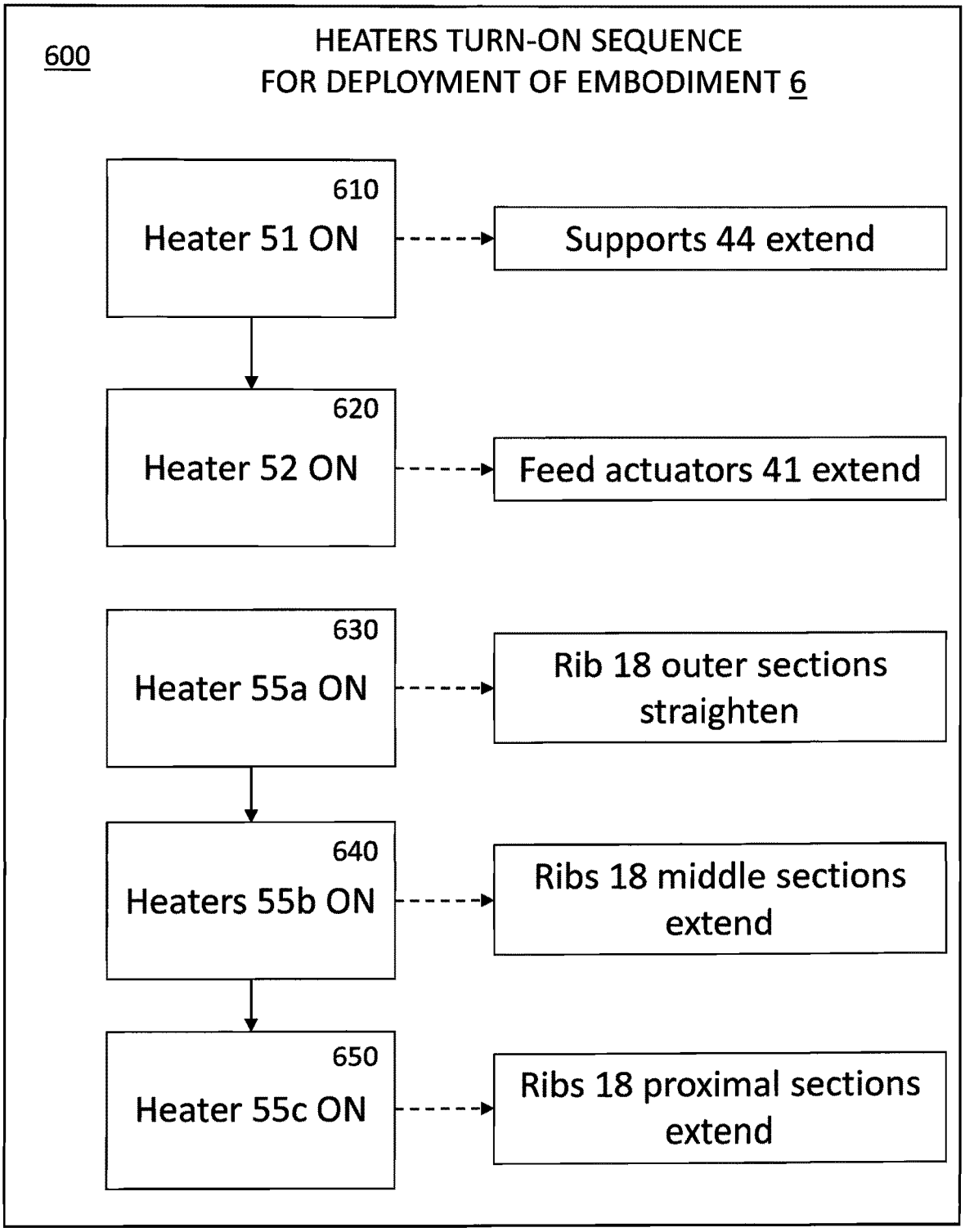
FIG. 46 is a diagram of the heaters activation sequence for antenna system embodiment 6.

Referring to FIG. 46, in sequence 600 which pertains to antenna system 6, supports 44 and feed 42 are extended by activating heaters 51 and 52 (steps 610 and 620) respectively. Rib elements 18 are controllably extended radially by a timed action of heaters 55*a*, 55*b* and 55*c*: first the distal tips of rib elements 18 are activated by heater 55*a* (step 630), then their middle sections activated by heater 55*b* (step 640), and finally their proximal ends activated by heater 55*c* (step 650). This sequence ensures reliable deployment of the flexible primary reflector 20 from the stored configuration outwards, to form a paraboloid reflector 20*a*.

Figure 47:
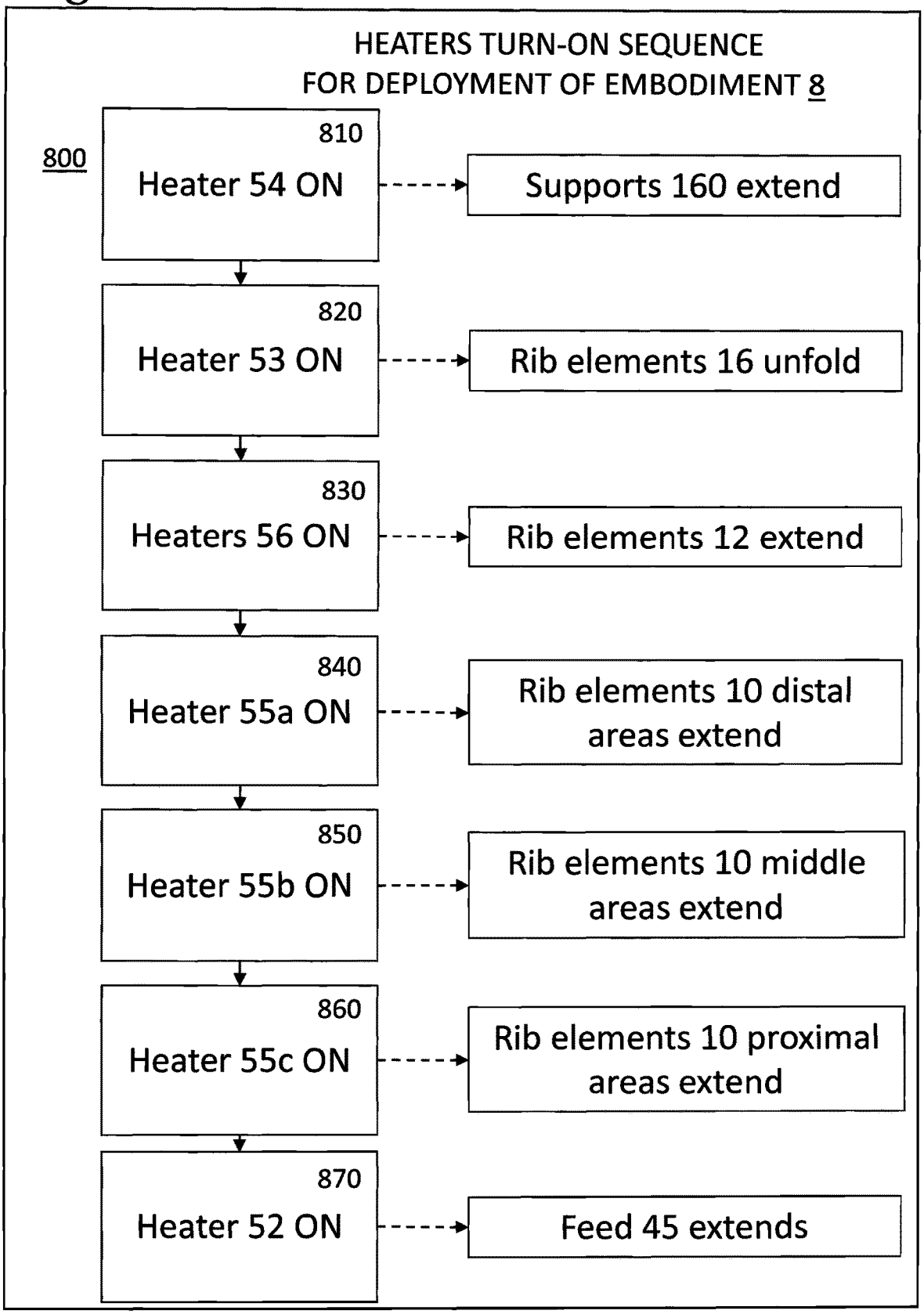
FIG. 47 is a diagram of the heaters activation sequence for antenna system embodiment 8.

Referring to FIG. 47, in sequence 800 which pertains to antenna system 8, supports 160 are extended by activating heater assembly 54 (step 810). Rib elements 16 are activated by heater 53 and unfold elements 12 and their heaters 56 (step 820). Rib elements 12 then radially extend as heaters 56 are turned on (step 830). Rib elements 10 are then controllably extended radially by a timed action of heaters 55*a*, 55*b* and 55*c*: first the distal tips of rib elements 10 are activated by heater 55*a* (step 840), then their middle sections activated by heater 55*b* (step 850), and finally their proximal ends activated by heater 55*c* (step 860). Telescopic feed 45 is then activated by the action of heater 52 (step 870). This sequence ensures reliable deployment of the flexible primary reflector 20 from its stored configuration outwards, to form a paraboloid reflector 20*a*.

Figure 48:
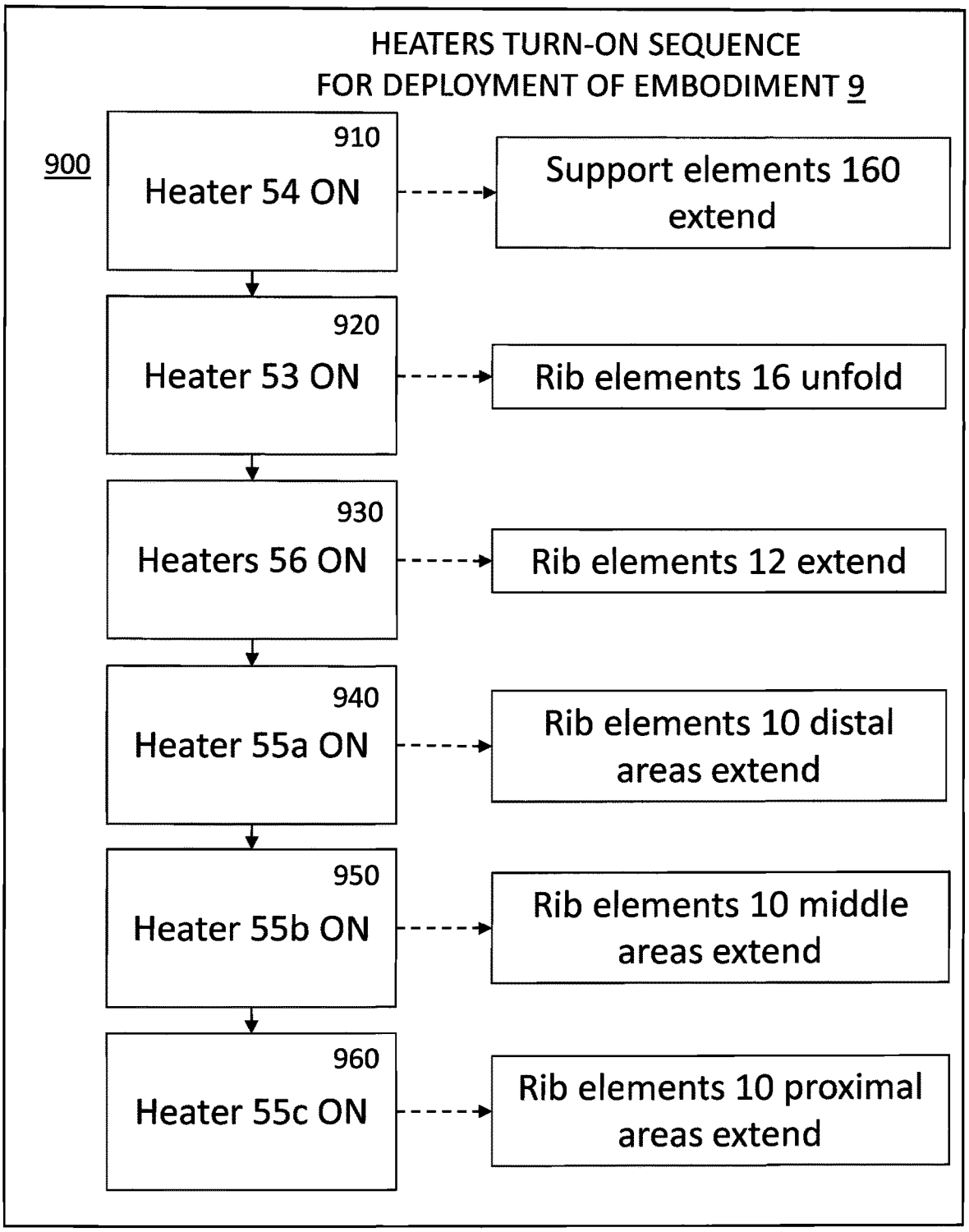
FIG. 48 is a diagram of the heaters activation sequence for antenna system embodiment 9.

Referring to FIG. 48, in sequence 900 which pertains to antenna system 9, supports 160 are extended first by activating heater assembly 54 (step 910). Rib elements 16 are then activated by heater 53 and unfold elements 12 and their heaters 56 (step 920). Rib elements 12 then radially extend as heaters 56 are turned on (step 930). Rib elements 10 are then controllably extended radially by a timed action of heaters 55*a*, 55*b* and 55*c*: first the distal tips of rib elements 10 are activated by heater 55*a* (step 940), then their middle sections activated by heater 55*b* (step 950), and finally their proximal ends activated by heater 55*c* (step 960). As ribs 17 assume their final deployed configuration, supports 160*a* assume their final deployed configuration 160*b* while positioning patch antenna 61 at the focus of reflector 20*a*.

Figure 49:
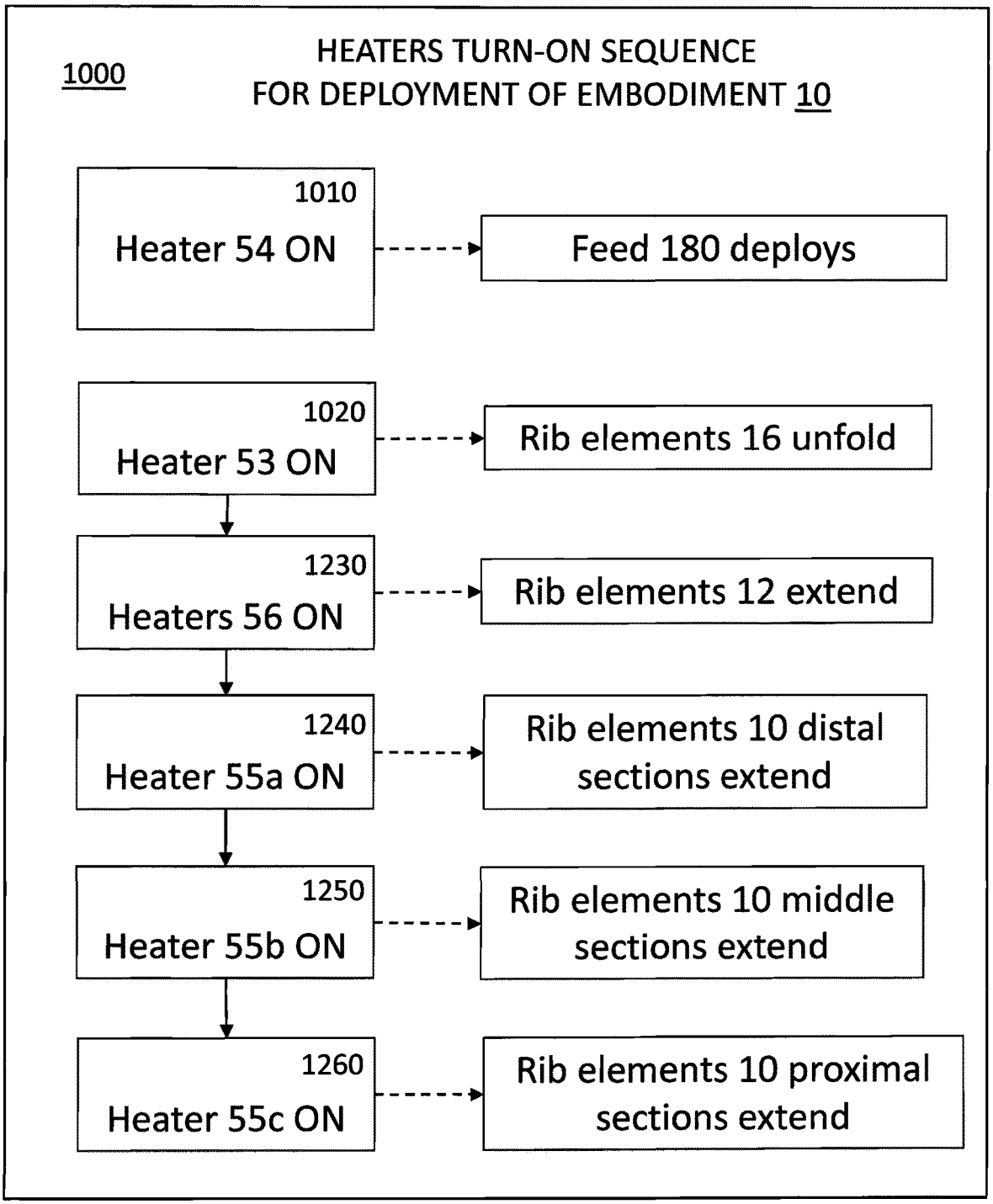
FIG. 49 is a diagram of the heaters activation sequence for antenna system embodiment 10.

Referring to FIG. 49, in sequence 1000 which pertains to antenna system embodiment 10. Ribbon feed 180 is deployed by being heated by heater assembly 54 (step 1010). Rib elements 16 of ribs 17 are activated by heater 53 and unfold elements 12 and their heaters 56 (step 1020). Rib elements 12 then radially extend as heaters 56 are turned on (step 1030). Rib elements 10 are then controllably extended radially by a timed action of heaters 55*a*, 55*b* and 55*c*: first the distal tips of rib elements 10 are activated by heater 55*a* (step 1040), then their middle sections activated by heater 55*b* (step 1050), and finally their proximal ends activated by heater 55*c* (step 1060).

Other Embodiments

Figure 32:
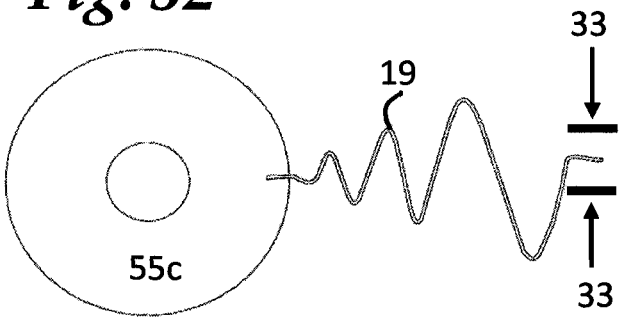
FIG. 32 is a plan view of the antenna rib 19 implemented in a heat pipe, connected to a heater, in stowed configuration.
Figure 33:
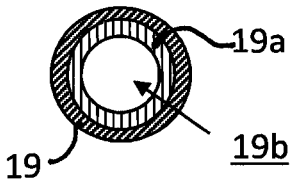
FIG. 33 is a cross section of the antenna rib 19 taken along line 33-33 on FIG. 32.

FIGS. 32 and 33 depict rib 19 implementation using heat pipe technology. A number of heat pipe technologies are well known in their respective art, and are widely used for heat transfer applications in satellites.

Hollow rib 19 is made of shape memory material, is hermetically sealed at both ends and filled with a phase-change heat transfer working compound. Rib 19 is then folded into the stowed configuration similar to rib element 10 of other embodiments and depicted on FIG. 32 as an example. As shown on FIG. 33 hollow rib 19 is lined inside with a wick layer 19*a* with lumen 19*b* occupied by a vapor phase of the heat transfer material. Heat to rib 19 can be applied by heater 55*c* which would be common to all ribs 19 of the antenna assembly replacing ribs 17 (not shown for clarity).

Heat pipes advantageously transfer heat from one of their ends to another. As a result, a heat pipe is uniquely suitable for heating the distal end of the heat pipe-based rib 19 first, so it extends before the rest of the rib 19's sections do.

As the distal end of rib 19 heats up and assumes its deployed shape, the heat is diffused along the rib and gradually raises the temperature of the middle—and then the proximal sections of rib 19.

As a result, ribs 19 in the antenna assembly radially extend to their full deployed length and shape and all of them working in cooperation stretch the coupled flexible reflector 20 to its deployed paraboloid configuration 20*a*.

Heat pipe technology can also be used for a version of coiled rib 18 and folded rib 17. For the heat pipe version of rib 18 the heat source required is 55*c*.

The heat sources required for the heat pipe version of rib 17 actuation are heater 53 used for unfolding operation and heater 55*c* for extension of sections 12 and 10 heat pipe versions.

By using heat pipe technology, heating of the shape memory elements can be simplified, since heat can be applied from proximal ends only (with the exception of a variant of folded rib 17).

Heaters 55*a*, 55*b* and 56 are no longer required for the assembly, since heat pipe technology will inherently heat up distal sections 12 slightly ahead of proximal sections 10 for reliable deployment and in steady state will ensure a fairly uniform temperature along entire ribs 17.

Additionally, feed actuators 41 and 48, supports 44 and 160, and ribbon feed 180 itself can all be realized with heat pipe technology.

By using heat pipe technology, heating of the shape memory elements can be greatly simplified, since heat can be applied from their proximal ends only and the resulting temperature distribution is fairly uniform from one end of a heat pipe to another.

The heat pipes working compound can be water, ammonia or other, the first two being especially chemically compatible with nickel-titanium shape memory alloys which can be utilized for the antenna system.

Other deployable antenna configurations, although not illustrated, are feasible.

For example, paraboloid reflectors made with thin flexible metallic membranes or foils stretched into the deployed shape by deployable ribs are possible.

Thin metallized polyimide films, e.g. MYLAR® and KAPTON® manufactured by DuPont, Inc. can be used for the flexible reflector 20.

Flexible metallic wire meshes stretched by the deployed ribs are also well known in the art.

Patch antenna 61 can have a receiver pre-amplifier and/or a transmit power amplifier integrated in a combined package held by supports 160*b*.

Skeleton rib antenna structures utilizing only supporting ribs 17 without reflector 20 can be used at lower operating frequencies.

Heaters 56 can be divided into several individually controlled sub-heaters to provide a more controlled heating of distal segments 12 of ribs 17.

Various heat sources can be used to activate the shape memory elements and deploy the antenna, such as sunlight, chemical heat generators, electric infrared sources, and nuclear sources.

Shape memory components can have thermally absorbing coatings to facilitate their heating and deployment by sunlight.

Electrical contacts used for direct heating of shape memory components by electric current can be made to disengage from the heated components upon deployment.

The electrical contacts can also be made frangible, to also disengage from the components upon deployment.

The power leads to the heaters on the shape memory components or the components themselves can be made retractable or coiled to retreat after the components' deployment.

Shape memory antenna components can have conductive or resistive film coating or coatings deposited on their surfaces on top of electrically insulating layer or layers in various patterns to facilitate their controlled heating by electric current applied to these coatings.

Heaters 55*a*, 55*b* and 55*c* can be combined in a single assembly.

The described feeds are interchangeable among the embodiments, except for embodiments 8 (its feed doesn't comprise reflector supports), 9 (does not require a feed) and 10 (has a unique feed configuration).

The feeds do not have to be centered with respect to the primary reflector, and the reflector itself does not have to be circularly symmetric. Rather, off-axis operation is possible, and, indeed, is practiced in the art.

Although shown as circular, feed lumens 43, 124*a* and 186*a* can be oval or rectangular, with different proportions. The resulting waveguides of these lumen geometries and their performance are well known in the art.

Although descriptions provided above contain many specific details, they should not be construed as limiting the scope of the present invention.

Thus, the scope of this invention should be determined from the appended claims and their legal equivalents.

I claim:

1. A deployable antenna system, comprising a flexible primary reflector, a central tubular hub, a plurality of deployable elongated support ribs, said ribs on their proximal ends connected to said hub, said ribs made of shape memory material, said ribs conditioned to have an initial elongated shape, said initial shape following a straight line in tangential dimension and a parabolic curve in sagittal dimension, said ribs coupled to said primary reflector, said ribs subsequently packaged into stowed configuration prior to deployment, said primary reflector packaged into stowed configuration prior to deployment, said ribs upon being heated to near or above transition temperature of said memory shape material extending radially and perpendicularly to a longitudinal axis of said hub and assuming deployed configuration, said deployed configuration corresponding to said initial elongated shape of said ribs, said deployed configuration of said ribs further defining a paraboloid framework, said primary reflector assuming paraboloid shape by cooperating with said framework.

2. The antenna system of claim 1 further comprising at least one heater, said heater actuating said ribs into said deployed configuration.

3. The heater of claim 2 comprising a plurality of annular heater elements, said elements disposed radially from said hub, said elements independently controlled for production of heat.

4. The ribs of claim 1 wherein heating of said ribs is effected by passing electric current directly therethrough.

5. The antenna system of claim 1 wherein said ribs comprise heat pipes.

6. The antenna system of claim 1 wherein each of said ribs further comprising a proximal section, a middle section and a distal section, said proximal section connected on its proximal end to said hub, said middle section in stowed configuration comprising a U-shape rotated by 90 degrees with respect to a longitudinal axis of said hub in sagittal plane of said system, wherein an apex of said U-shape points radially outwards from said hub, said proximal section connected by its distal end to a first arm of said U-shape, said distal section connected by its proximal end to a second arm of said U-shape, wherein said distal section points radially toward said hub in said stowed configuration, said middle section upon being heated to near or above transition temperature of said memory shape material unfolding radially and outwardly with respect to said hub.

7. The antenna system claim 6 further comprising at least one tubular heater disposed around the periphery of said middle sections when said sections are in said stowed configuration, said heater positioned coaxially with said hub, said heater upon activation causing said middle sections to unfold radially and outwardly with respect to said hub.

8. The distal rib sections of claim 6 each further comprising at least one heater element.

9. The antenna system of claim 1 additionally comprising a feed, said feed having a first stowed configuration and a second deployed configuration, said feed made of shape memory material, said feed upon being heated to near or above transition temperature of said material transforming from its said stowed configuration to its said deployed configuration comprising a tubular structure, said structure further comprising a lumen, said lumen comprising dimensions conducive for conducting electromagnetic radiation therethrough.

10. The feed of claim 9 wherein heating of said feed is effected by at least one externally located heater.

11. The feed of claim 9 wherein heating of said feed is effected by passing electric current directly therethrough.

12. The feed of claim 9 comprising in said stowed configuration a hollow axially pleated cylindrical shell, said feed upon being heated to near or above transition temperature of said material transforming from said stowed configuration to deployed configuration comprising a smooth tubular structure.

13. The feed of claim 9 comprising in said stowed configuration a flattened tubular ribbon, said feed upon being heated to near or above transition temperature of said material transforming from its said stowed configuration to its said deployed configuration comprising a tubular structure.

14. The antenna system of claim 1 additionally comprising a feed, said feed having a first stowed configuration and a second deployed configuration, said feed in said stowed configuration comprising at least two nested co-axial tubular telescopic elements, namely, an outermost telescopic element and an innermost telescopic element, said innermost element nesting inside said outermost element, said feed further comprising an actuator, said actuator comprising at least two ends, namely a first end and a second end, said first end connected to said outermost element, said second end connected to said innermost element, said actuator made of shape memory material, said actuator upon being heated to near or above transition temperature of said material extending longitudinally, said actuator urging said elements to extend from said stowed configuration to said deployed configuration of said feed.

15. The actuator of claim 14 comprising a helical coil, said coil made of memory shape material, said coil disposed co-axially around said telescopic elements, said coil comprising two ends, namely a first end and a second end, said coil connected on said first end to a proximal end of said outermost telescopic element and on its said second end to a distal end of said innermost telescopic element, said coil prior to deployment comprising a first stowed shape, said coil extending lengthwise from its said stowed shape to its second deployed shape by being heated to near or above transition temperature of said memory shape material, said coil urging said telescopic elements into said deployed configuration of said feed.

16. The actuator of claim 14 comprising at least one elongated rod, said rod made of shape memory material, said rod folded in stowed configuration, said rod comprising two ends, namely a first end and a second end, said first end connected to said outermost telescopic element, said second end connected to said innermost telescopic element, said rod straightening from said stowed configuration to a deployed configuration upon being heated to near or above transition temperature of said memory shape material, said rod extending said telescopic feed and urging said telescopic elements to assume said deployed configuration of said feed.

17. The actuator of claim 14 wherein heating of said actuator is effected by passing electric current directly therethrough.

18. The actuator of claim 14 wherein heating of said actuator is effected by at least one external heater.

19. The actuator of claim 14 comprising a heat pipe.

20. The feed of claim 9 further comprising a secondary reflector, wherein said feed and said reflector comprise a unified assembly, said assembly additionally comprising at least one support for said reflector, said support made from shape memory material, said support comprising at least one elongated rod, said rod having a proximal end and a distal end, said rod folded in its storage configuration, said support connected at its proximal end to a distal end of said feed, said support connected at its distal end to said secondary reflector, said support upon being heated to near or above transition temperature of said memory shape material extending and positioning said secondary reflector in its deployed position.

21. The support of claim 14 further comprising a heat pipe.

22. The antenna system of claim 1 further comprising a secondary reflector, said reflector supported by at least one support element, said support made from shape memory material, said support comprising at least one elongated rod, said rod having a proximal end and a distal end, said rod folded in its storage configuration, said support connected at its proximal end to a distal end of one or more of said ribs, said support connected on its distal end to said secondary reflector, said support extending to its deployed configuration upon being heated to near or above transition temperature of said memory shape material.

23. The antenna system of claim 1 further comprising a patch antenna, said patch antenna supported by at least one support element, said support made from shape memory material, said support comprising at least one elongated rod, said rod having a proximal end and a distal end, said rod folded in its storage configuration, said support connected at its proximal end to a distal end of one or more of said ribs, said support connected on its distal end to said patch antenna, said support extending to its deployed configuration upon being heated to near or above transition temperature of said memory shape material and positioning said patch antenna in its deployed.

24. The antenna of claim 1 wherein said ribs in their stowed configuration each comprise at least two straight sections.

25. The antenna of claim 1 wherein said ribs in their stowed configuration each comprise at least one helical coil segment, wherein the axis of said coil does not coincide with the longitudinal axis of said hub.

26. A method of deploying a paraboloid antenna, comprising supplying a deployable paraboloid antenna, said antenna comprising a flexible primary reflector, said antenna further comprising a central hub, said antenna further comprising a plurality of elongated support ribs, said ribs made from a shape memory material, conditioning said ribs to have elongated shape, said elongated shape following a straight line in tangential dimension and a parabolic curve in sagittal dimension, connecting said ribs on their proximal ends to said hub, coupling said ribs to said primary reflector, packaging said ribs into stowed configuration, packaging said reflector into stowed configuration, subsequently applying heat to said ribs at or above transition temperature of said shape memory material to cause them to extend radially and perpendicularly to a longitudinal axis of said hub from said stowed configuration into deployed configuration, said deployed configuration corresponding to said elongated shape of said ribs, said deployed configuration further defining a paraboloid framework, causing said primary reflector to assume deployed paraboloid configuration by cooperating with said framework.

27. The method of claim 26, said antenna further comprising a feed, said feed coaxially passing through said hub, said feed made from memory shape material, said feed collapsed in stowed configuration, applying heat to said feed at or above transition temperature of said shape memory material to cause said feed to assume its deployed configuration comprising a tubular shape.

28. The method of claim 26, said antenna further comprising a tubular telescopic feed, said feed coaxially passing through said hub, said feed collapsed in stowed configuration, said feed further comprising a deployment mechanism, said mechanism made from memory shape material, applying heat to said deployment mechanism at or above transition temperature of said shape memory material to cause said mechanism to extend said feed into its deployed configuration comprising a tubular shape.

* * * * *